US008696087B2

(12) United States Patent
Tamaki

(10) Patent No.: US 8,696,087 B2
(45) Date of Patent: Apr. 15, 2014

(54) LIQUID EJECTION APPARATUS

(71) Applicant: Shuichi Tamaki, Nagoya (JP)

(72) Inventor: Shuichi Tamaki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/781,629

(22) Filed: Feb. 28, 2013

(65) Prior Publication Data

US 2013/0221127 A1 Aug. 29, 2013

(30) Foreign Application Priority Data

Feb. 29, 2012 (JP) ..... 2012-042981

(51) Int. Cl.
*B41J 2/165* (2006.01)

(52) U.S. Cl.
USPC ..... 347/29; 347/21; 347/30

(58) Field of Classification Search
USPC ..... 347/20–22, 29–33, 34–37, 40, 45–47, 347/89–90
See application file for complete search history.

(56) References Cited

U.S. PATENT DOCUMENTS

| | | | | |
|---|---|---|---|---|
| 6,158,838 | A * | 12/2000 | Capurso | 347/28 |
| 6,491,369 | B1 * | 12/2002 | Satoh et al. | 347/30 |
| 2010/0147891 | A1 | 6/2010 | Yoshihisa | |
| 2011/0242204 | A1 | 10/2011 | Shinoda | |
| 2013/0222469 | A1 | 8/2013 | Tamaki | |
| 2013/0222470 | A1 | 8/2013 | Tamaki | |

FOREIGN PATENT DOCUMENTS

| | | | |
|---|---|---|---|
| JP | 2005-212138 | A | 8/2005 |
| JP | 2011-207091 | A | 10/2011 |

* cited by examiner

*Primary Examiner* — Thinh Nguyen
(74) *Attorney, Agent, or Firm* — Baker Botts L.L.P.

(57) ABSTRACT

An inflow opening of an inflow path opens to a space in a tank. An outflow opening of an outflow path opens to the space in the tank. The inflow opening and the outflow opening are vertically above a maximum level of the moisturizing liquid allowed to be stored in the tank.

20 Claims, 14 Drawing Sheets

LIQUID EJECTION APPARATUS

CROSS REFERENCE TO RELATED APPLICATION

The present application claims priority from Japanese Patent Application No 2012-042981, which was filed on Feb. 29, 2012, the disclosure of which is incorporated herein by reference in its entirety.

BACKGROUND OF THE INVENTION

1. Field of the Invention

The present invention relates to a liquid ejection apparatus capable of ejecting liquid such as ink.

2. Description of Related Art

In connection with liquid ejection apparatuses, a technology of moisturizing an ejection space opposing an ejection surface of a head while isolating the ejection space from its surrounding space by a capping mechanism has been known. For example, a known technology is arranged such that air in the ejection space is supplied to a tank, moisturization is conducted while generating bubbles in the tank, and then the moisturized air is sent back to the ejection space.

SUMMARY OF THE INVENTION

However, according to the technology above, because the moisturization is carried out while bubbles are generated in the tank, splash droplets of the moisturizing liquid are generated along with the bubbles in the tank, and the droplets may enter an outflow path. The droplets. having entered the ejection space through the outflow path adhere to the ejection surface and hence the viscosity of the liquid in an ejection opening is decreased and the meniscus of the liquid formed in the ejection opening may be broken.

An object of the present invention is to provide a liquid ejection apparatus in which the generation of bubbles and splash droplets of moisturizing liquid in a tank are restrained.

According to a first aspect of the present invention, there is provided a liquid ejection apparatus comprising a head, a tank, an inflow path, an outflow path, and a ventilator. The head comprises an ejection surface in which a plurality of ejection openings for ejecting liquid are formed. The tank is configured to store moisturizing liquid. The inflow path connects a space in the tank with an ejection space opposing the ejection surface, and is configured to allow air flow from the ejection space towards the tank passing through the inflow path. An inflow opening of the inflow path opens to the space in the tank. The outflow path connects the space in the tank with the ejection space, and is configured to allow air flow from the tank towards the ejection space passing through the outflow path. An outflow opening of the outflow path opens to the space in the tank. The ventilator is configured to move the air in'the inflow path to the space in the tank and to move the air in the outflow path to the ejection space. The inflow opening and the outflow opening are vertically above a maximum level of the moisturizing liquid allowed to be stored in the tank.

According to a second aspect of the present invention, there is provided a liquid ejection apparatus comprising a head, a tank, an inflow path, an outflow path, and a ventilator. The head comprises an ejection surface in which a plurality of ejection openings for ejecting liquid are formed. The tank is configured to store moisturizing liquid. The inflow path connects a space in the tank with an ejection space opposing the ejection surface, and is configured to allow air flow from the ejection space towards the tank passing through the inflow path. An inflow opening of the inflow path opens to the space in the tank. The outflow path connects the space in the tank with the ejection space, and is configured to allow air flow from the tank towards the ejection space passing through the outflow path. An outflow opening of the outflow path opens to the space in the tank. The ventilator is configured to move the air in the inflow path to the space in the tank and to move the air in the outflow path to the ejection space. The inflow opening and the outflow opening are disposed at an upper half portion of the tank.

According to a third aspect of the present invention, there is provided a liquid ejection apparatus comprising a head, a tank, an inflow path, an outflow path, a ventilator, a level sensor, a supplying device, and a controller. The head comprises an ejection surface in which a plurality of ejection openings for ejecting liquid are formed. The tank is configured to store moisturizing liquid. The inflow path connects a space in the tank with an ejection space opposing the ejection surface, and is configured to allow air flow from the ejection space towards the tank passing through the inflow path. An inflow opening of the inflow path opens to the space in the tank. The outflow path connects the space in the tank with the ejection space, and is configured to allow air flow from the tank towards the ejection space passing through the outflow path. An outflow opening of the outflow path opens to the space in the tank. The ventilator is configured to move the air in the inflow path to the space in the tank and to move the air in the outflow path to the ejection space. The level sensor is configured to detect a level of moisturizing liquid stored in the tank. The supplying device connects the tank and is configured to supply the tank with the moisturizing liquid. The controller is configured to control the supplying device to supply the tank with the moisturizing liquid based on the detection result of the level sensor such that the inflow opening and the outflow opening are vertically above a level of the moisturizing liquid stored in the tank.

According to a fourth aspect of the present invention, there is provided a liquid ejection apparatus comprising a head, a tank, an inflow path, an outflow path, and a ventilator. The head comprises an ejection surface in which a plurality of ejection openings for ejecting liquid are formed. The tank is configured to store moisturizing liquid and to discharge moisturizing liquid through a discharge opening disposed at a side surface of the tank. The inflow path connects a space in the tank with an ejection space opposing the ejection surface, and is configured to allow air flow from the ejection space towards the tank passing through the inflow path. An inflow opening of the inflow path opens to the space in the tank. The outflow path connects the space in the tank with the ejection space, and is configured to allow air flow from the tank towards the ejection space passing through the outflow path. An outflow opening of the outflow path opens to the space in the tank. The ventilator is configured to move the air in the inflow path to the space in the tank and to move the air in the outflow path to the ejection space. The inflow opening and the outflow opening are vertically above the discharge opening.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

The following will describe a preferred embodiment of the present invention with reference to figures.

Figure 1:
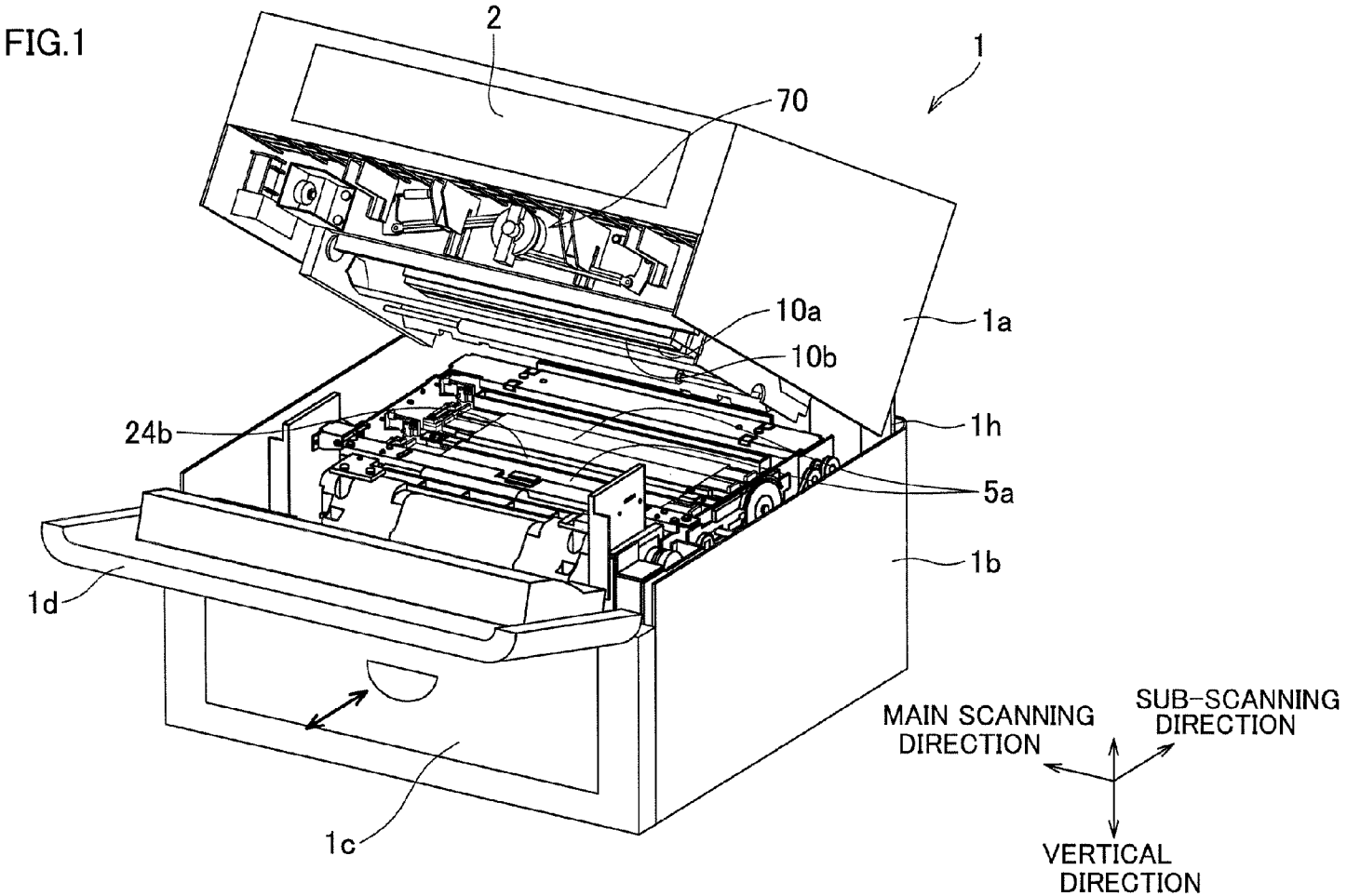
FIG. 1 is an oblique perspective of the appearance of an inkjet printer of First. Embodiment of the present invention.

To begin with, referring to FIG. 1 and FIG. 2, the overall structure of an inkjet printer 1 of First Embodiment of the present invention will be described.

The printer 1 includes an upper housing 1*a* and a lower housing 1*b* which are both rectangular parallelepiped and are substantially identical in size. The upper housing 1*a* is an open-bottom box whereas the lower housing 1*b* is an open-top box. As the upper housing 1*a* is put on the lower housing 1*b* so that each closes the opening of the other, the space inside the printer 1 is defined (see FIG. 2).

On the top plate of the upper housing 1 a is provided a sheet discharge section 31. In the space defined by the housings 1*a* and 1*b*, a conveying path on which sheets P are conveyed is formed from a sheet supply unit 1*c* toward a sheet discharge section 31, along the thick arrows shown in FIG. 2.

The upper housing 1*a* is arranged to be rotatable with respect to the lower housing lb about a hinge 1*h* which is a lower side of the upper housing 1*a*. On account of the rotation, the upper housing 1*a* selectively takes a close position (FIG. 2) where the upper housing 1*a* is close to the lower housing 1*b* or a separated position (FIG. 1) where the upper housing 1*a* is separated from the lower housing 1*b* as compared to the close position. The upper housing 1*a* is regulated by a stopper or the like so as not to open more than a predetermined angle (e.g., 29 degrees) with respect to the horizontal plane. When the upper housing 1*a* is at the separated position, a part of the conveying path is exposed and a working space for the user is formed between the upper housing 1*a* and the lower housing 1*b*. This working space allows the user to manually clean heads 10*a* and 10*b*, remove a sheet P jammed at the conveying path, and so on.

On the front surface of the upper housing 1*a* (i.e., the face on the left side in FIG. 1) are provided a cartridge 2 and a locking mechanism 70. The cartridge 2 includes a preprocessing liquid container containing preprocessing liquid, an ink container containing black ink, a moisturizing liquid container containing moisturizing liquid, and a housing which houses these three containers. The preprocessing liquid has a function of preventing ink from spreading on or penetrating a sheet, a function of improving the coloring and quick dry properties of the ink, or the like, by coagulating pigment in the ink. The preprocessing liquid may include polyvalent metal salt such as cationic polymer and magnesium salt. The moisturizing liquid may be water to which pure water, preservative or the like is added. The preprocessing liquid container, the ink container, and the moisturizing liquid container are connected to a head 10*a*, a head 10*b*, and a tank 51 (see FIG. 9) via tubes or the like, respectively. The liquid in each container is suitably supplied to each of the heads 10*a* and 10*b* and the tank 51 by the driving of pumps 2P*a*, 2P*b*, and 2Pc (see FIG. 11) under the control of the controller 1*p*. The locking mechanism 70 restricts the movement of the upper housing 1*a* when the upper housing 1*a* is at the close position. On the front surface of the lower housing 1*b* is provided a lid 1*d* which is openable and able to cover the front surface of the upper housing 1*a*. As the lid 1*d* is opened, the locking mechanism 70 is exposed. The details of the locking mechanism 70 will be given later.

Figure 2:
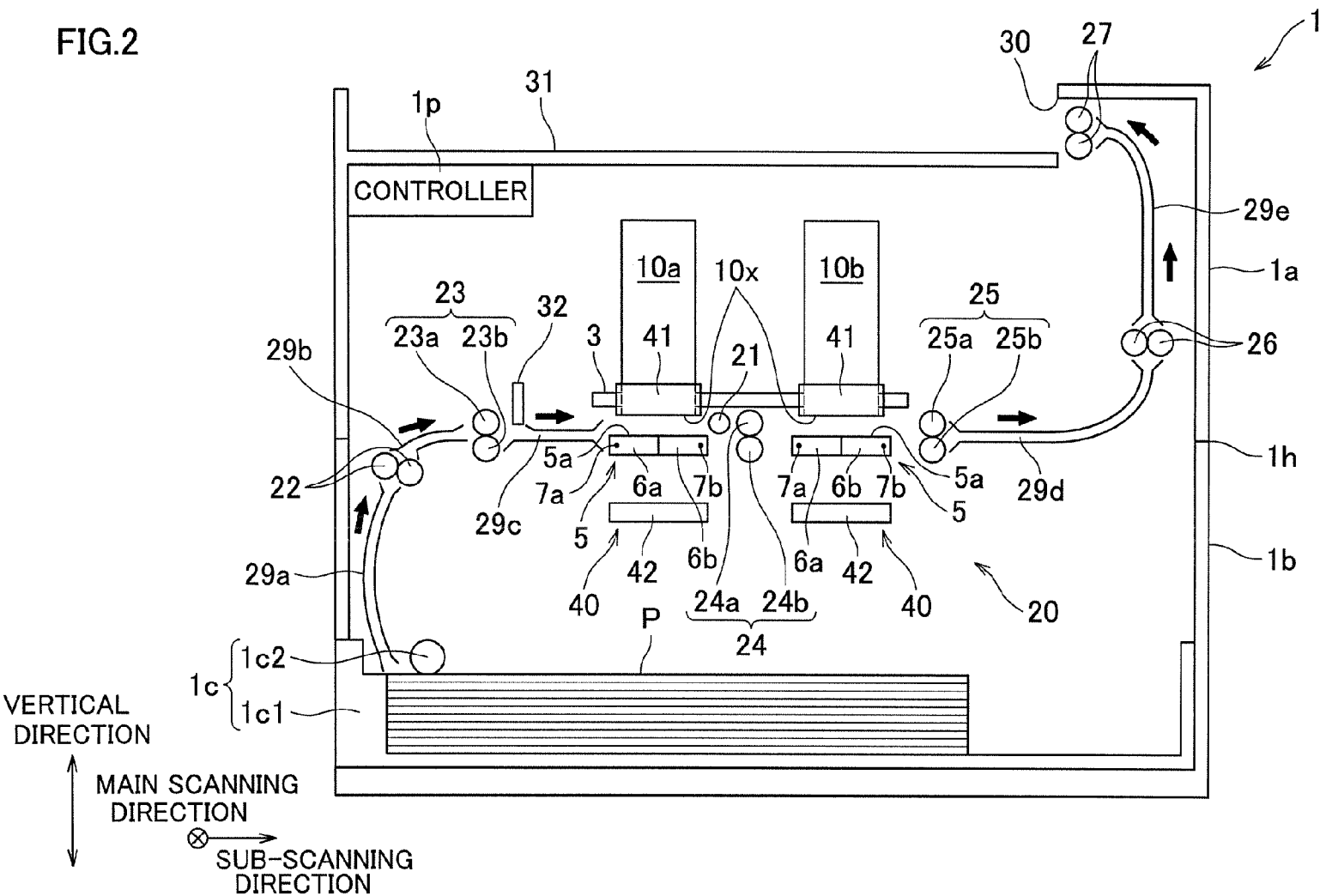
FIG. 2 is a schematic profile showing the internal structure of the printer.
Figure 8A:
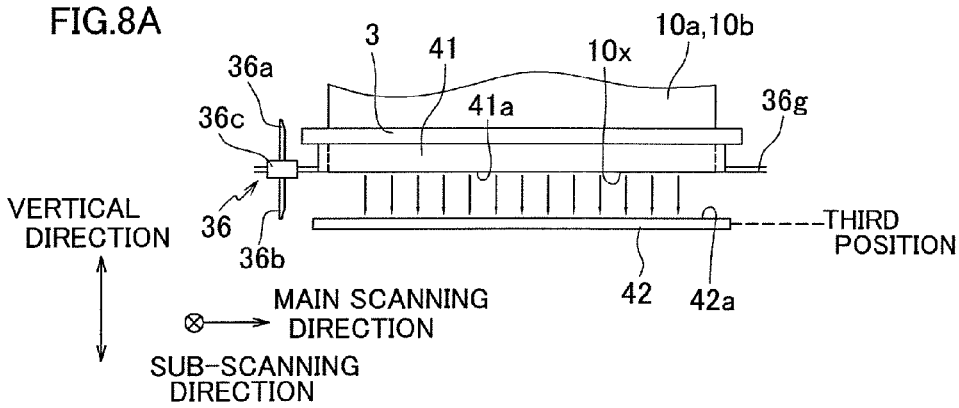
FIG. 8A illustrates purging.

The upper housing 1*a* supports members such as the heads 10*a* and 10*b*, a controller 1*p*, and a part of the conveying unit 20 (see FIG. 2). The lower housing 1*b* supports members such as opposing members 42, the remaining part of the conveying unit 20, a sheet supply unit 1*c*, wiper units 36 (see FIG. 8A to FIG. 8C) provided for the respective heads 10*a* and 10*b*, and a tank 51 (see FIG. 9) of the moisturizing unit 50.

The heads 10*a* and 10*h* are identical with each other in structure and are line-type heads each being substantially rectangular parallelepiped and long in the main scanning direction (i.e., in the direction orthogonal to FIG. 2). For recording (image formation), preprocessing liquid and black ink (which may be referred to generally as liquid) are ejected from the lower surface (ejection surface 10*x*) of each of the heads 10*a* and 10*b*. The heads 10*a* and 10*b* are disposed at predetermined intervals in the sub-scanning direction (which is orthogonal to the main scanning direction and the vertical direction), and are supported by the upper housing 1*a* via a holder 3. The holder 3 also supports an annular member 41 which is provided for each of the heads 10*a* and 10*b*. The annular member 41 encloses the ejection surface 10*x* in plan view.

The opposing members 42 are disposed vertically below the respective heads 10*a* and 10*b*. The opposing member 42 is a rectangular plate which is a size larger than the annular member 41 and made of a material which does not absorb or hardly absorbs moisture, such as glass and metal (e.g., SUS). The annular member 41 and the opposing member 42 constitute a capping mechanism 40. The details of the capping mechanism 40 will be given later.

The conveying unit 20 includes supporting mechanisms 5, roller pairs 22, 23, 24, 25, 26, and 27, guides 29*a*, 29*b*, 29*c*, 29*d*, and 29*e*, and an intermediate roller 21.

Among the members of the conveying unit 20, the intermediate roller 21, the upper roller 24*a* of the roller pair 24, the roller pairs 26 and 27, and the guides 29*d* and 29*e* are supported by the upper housing 1*a*. The supporting mechanisms 5, the roller pairs 22, 23, and 25, the lower roller 24*b* of the roller pair 24, and the guides 29*a*, 29*b*, and 29*c* are supported by the lower housing 1*b*.

The supporting mechanisms 5 are disposed vertically below the heads 10*a* and 10*b*, respectively. Each supporting mechanism 5 is constituted by two platens 6*a* and 6*b*. The platens 6*a* and 6*b* are arranged to be rotatable about the shafts 7*a* and 7*b*. Under the control of the controller 1*p*, the platens 6*a* and 6*b* are rotated by a platen rotation motor 5M (see FIG. 11), and selectively take a supporting surface forming position (FIG. 1) or an open position (FIG. 7B). At the supporting surface forming position, the leading ends of the platens 6*a* and 6*b* contact each other and these platens 6*a* and 6*b* form the supporting surface 5*a* which supports a sheet P while opposing the ejection surface 10*x*. The supporting surface 5*a* is basically flat in shape. At the open position the platens 6*a* and 6*b* hang down. The platens 6*a* and 6*b* are at the supporting surface forming position at the time of recording, and are at the open position at the time of maintenance.

The maintenance is operations to restore or maintain the state of the liquid in an ejection opening 14*a*, including capping, wiping, a liquid discharge operation (including flushing and purging), a moisturization operation, or the like. These operations are executed when, for example, a user instructs to perform it while the controller 1*p* does not receive a recording command. The details of the operations will be given later.

The roller pairs 22 to 27 are disposed in this order from the upstream in the conveyance direction to form a conveying path connecting the sheet supply unit 1*c* with the sheet discharge section 31. The lower rollers 23*b*, 24*b*, and 25*b* of the roller pairs 23 to 25 and one rollers of the roller pairs 26 and 27 are connected to a conveyance motor 20M (see FIG. 11). These rollers are drive rollers which are rotated by the conveyance motor 20M under the control of the controller 1*p*. The upper rollers 23*a*, 24*a*, and 25*a* of the roller pair 23 to 25 and the other rollers of the roller pairs 26 and 27 are driven rollers.

The guides 29*a* to 29*e* are disposed in this order between the sheet supply unit 1*c* and the roller pair 22 and between the roller pairs from the upstream in the conveyance direction, so as to form the conveying path. Each of the guides 29*a* to 29*e* is constituted by a pair of plates which are distanced from each other.

The intermediate roller 21 is disposed between the head 10*a* and the roller pair 24 and vertically above the conveying path.

The sheet supply unit 1*c* includes a sheet feeding tray 101 and a pickup roller 1*c*2. The sheet feeding tray 1*e*1 is detachable to the lower housing 1*b* in the sub-scanning direction. The sheet feeding tray 1*c*1 is an open-top box capable of storing sheets P with different sizes. Under the control of the controller 1*p*, the pickup roller 1*e*2 is rotated by a pickup motor 1*c*M (see FIG. 11) to send out the vertically topmost sheet P in the sheet feeding tray 1*e*1.

The controller 1*p* includes, in addition to a CPU (Central Processing Unit) which is a processing unit, members such as a ROM (Read Only Memory), a RAM (Random Access Memory: including non-volatile RAM), an ASIC (Application Specific Integrated Circuit), an I/F (Interface), an I/O (Input/Output Port), and an internal timer for measuring time. The ROM stores a program executed by the CPU, various fixed data, or the like. The RAM temporarily stores data (such as image data) required for the execution of a program. The ASIC executes the rewriting, sorting or the like (e.g., signal processing and image processing) of image data. The I/F exchanges data with an external apparatus. The I/O deals with input/output of detection signals of various sensors. Alternatively, no ASIC may be provided and the rewriting, sorting or the like of image data may be performed by a program executed by the CPU or the like.

Based on a recording command supplied from an external apparatus (e.g., a PC connected to the printer 1), the controller 1*p* controls the preparation operation concerning recording, the supply/conveyance/discharge operation of a sheet P, a liquid ejection operation in sync with the conveyance of a sheet P, or the like, in order to form an image on the sheet P. A sheet P sent out from the sheet supply unit 1*c* passes through the spaces between the guides 29*a* to 29*e* and is conveyed in the conveyance direction, while being sandwiched between the roller pairs 22 to 27. Each time a sheet P passes through the position immediately below each of the heads 10*a* and 10*b* while being supported by the supporting surface 5*a*, each of the heads 10*a* and 10*b* is driven under the control of the controller 1*p* and liquid is ejected from an ejection opening 14*a* (see FIG. 6) of each ejection surface 10*x* to the surface of the sheet P, with the result that an image is formed on the sheet P. The operation to eject the liquid from the ejection opening 14*a* is performed based on a detection signal supplied from a sheet sensor 32 which detects the leading end of a sheet P. The sheet P is then conveyed upward and is discharged to the sheet discharge section 31 through an opening 30 which, is formed at an upper part of the upper housing 1*a*.

Figures 3A, 3B:
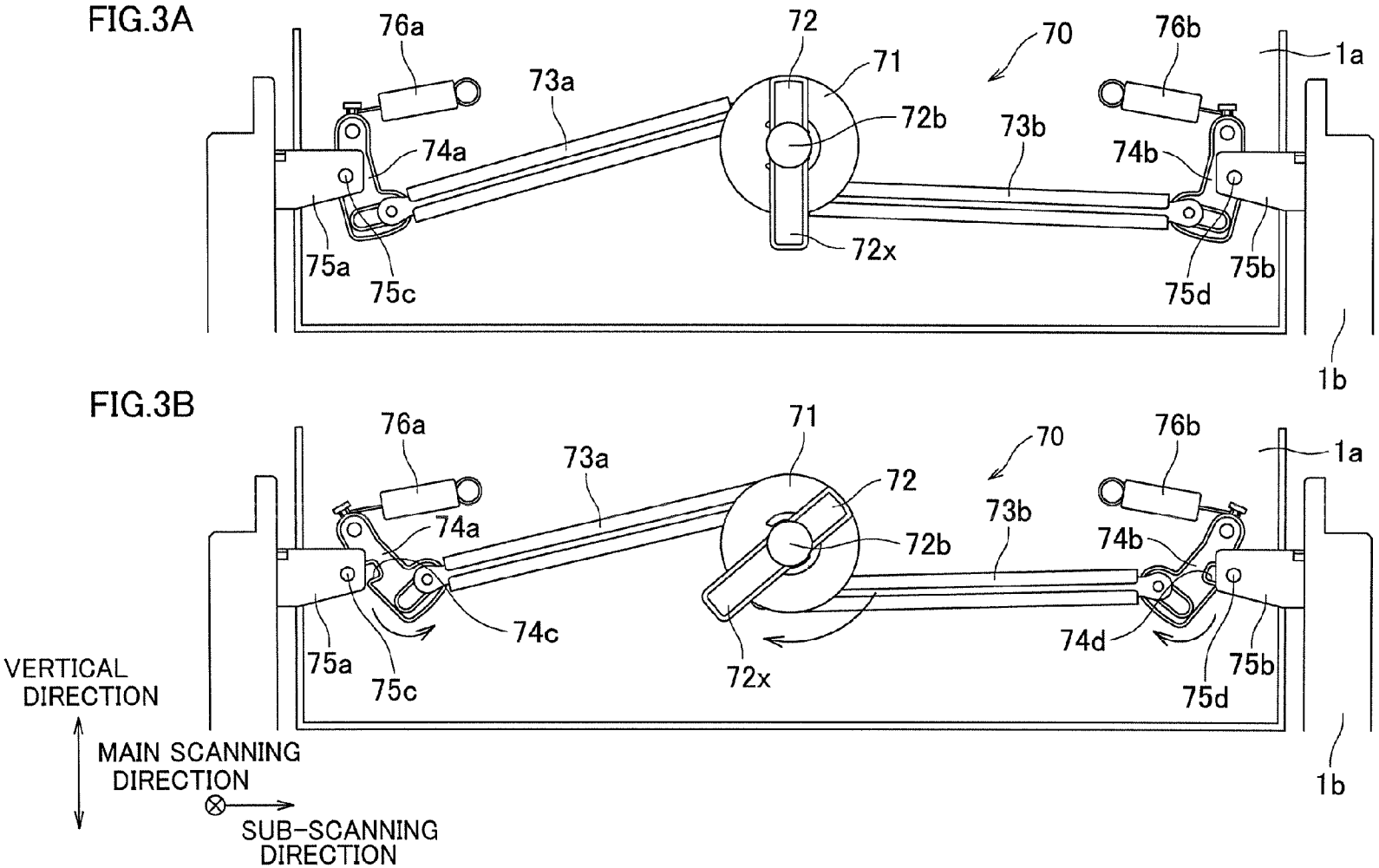
FIG. 3A is an elevation view of a locking mechanism, showing the state in which the movement of an upper housing is restricted by the locking mechanism.
FIG. 3B is an elevation view of the locking mechanism, showing that the restriction of the movement of the upper housing by the locking mechanism has been released.

Now, referring to FIG. 3A and FIG. 3B, the details of the locking mechanism. 70 will be given.

The locking mechanism 70 includes a cylindrical rotating member 71, two interlocking members 73*a* and 73*b*, two swing members 74*a* and 74*b*, two springs 76*a* and 76*b*, and two fixing members 75*a* and 75*b*. An end of each of the interlocking members 73*a* and 73*b* in the longitudinal direction is connected to the peripheral surface of the rotating member 71. The swing members 74*a* and 74*b* have concave portions 74*c* and 74*d* which are open in the directions away from the rotating member 71*a*, respectively. The fixing members 75*a* and 75*b* respectively have shaft members 75*c* and 75*d* which are capable of being inserted into the concave portions 74*c* and 74*d*, respectively. The swing shafts of the swing members 74*a* and 74*b* are fixed to the upper housing 1*a*. The springs 76*a* and 76*b* are fixed to the upper housing 1*a* at ends which are close to the rotating member 71*a*. The fixing members 75*a* and 75*b* are fixed to the lower housing 1*b*.

On the front surface of the rotating member 71 is fixed a stick-shaped knob 72. The knob 72 rotates together with the rotating member 71. The springs 76*a* and 76*b* bias the upper ends of the swing members 74*a* and 74*b* toward the rotating member 71. With the arrangement above, when no external force is applied, the members of the locking mechanism 70 are, as shown in FIG. 3A, in a static state while the knob .72 extends in the vertical direction. In this state, the concave portions 74*c* and 74*d* are engaged with the shaft members 75*c* and 75*d*, respectively, Because of this engagement, the movement of the upper housing 1*a* is restricted so that the upper housing 1*a* at the close position do not rotate toward the separated position. As the user rotates the knob 72 clockwise against the biasing forces of the springs 76*a* and 76*b*, as shown in FIG. 3B, the concave portions 74*c* and 74*d* are disengaged from the shaft members 75*c* and 75*d*. With this, the restriction of the movement of the upper housing 1*a* is released. As the upper housing 1*a* is returned from the separated position to the close position, the concave portions 74*c* and 74*d* are engaged with the shaft members 75*c* and 75*d* again. With this, the movement of the upper housing 1*a* is restricted by the locking mechanism 70 again.

Figure 4:
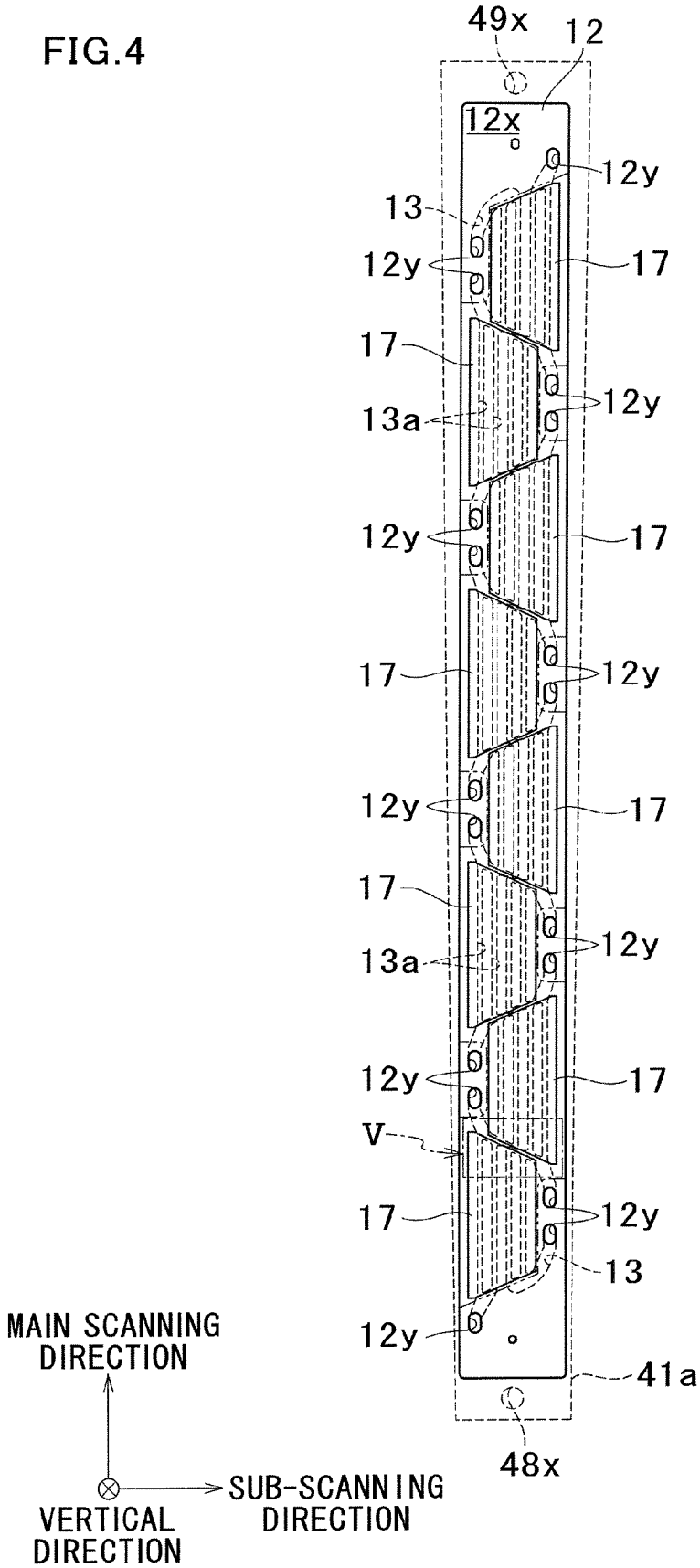
FIG. 4 is a plan view of a passage unit and an actuator unit of a head.
Figure 5:
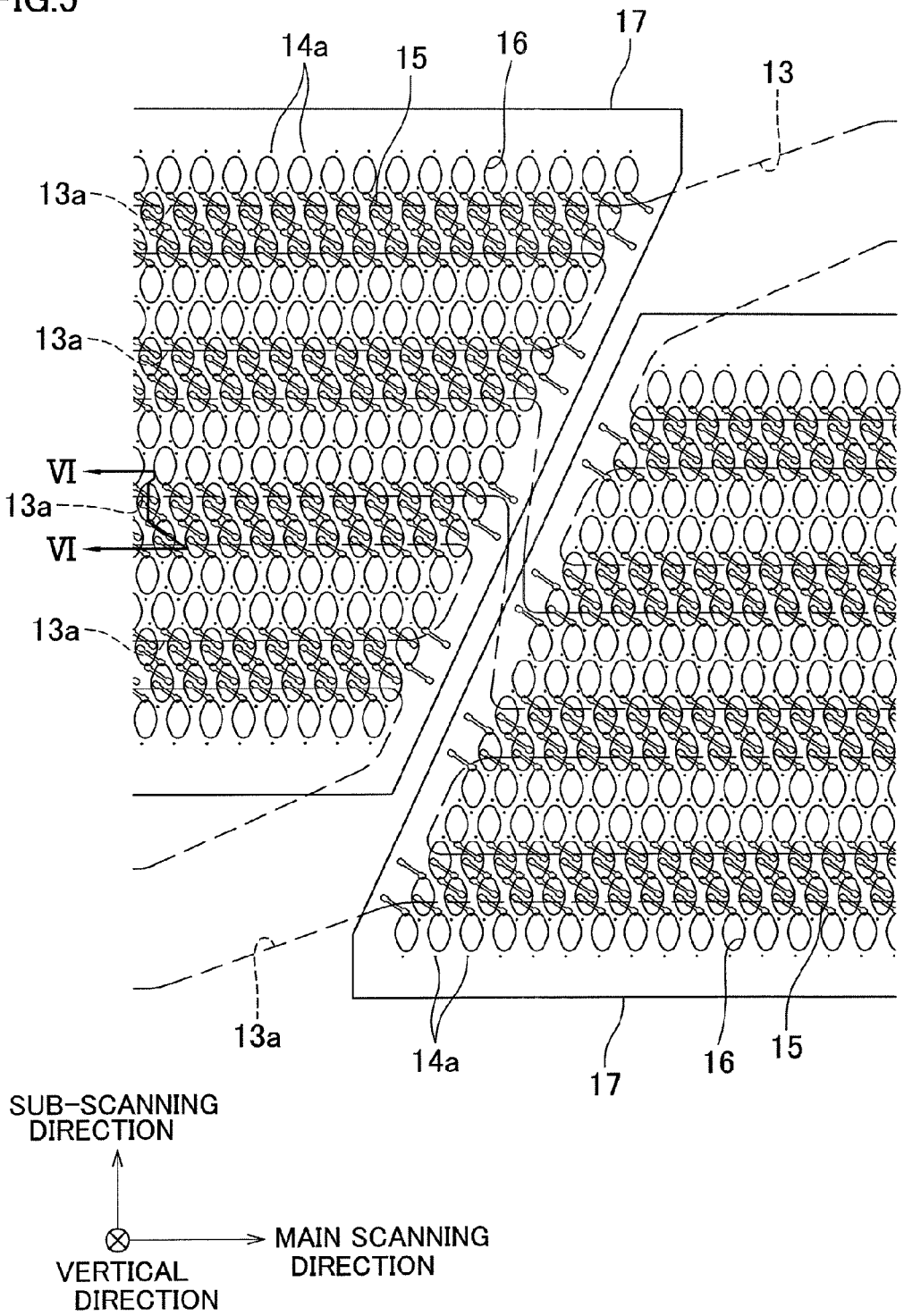
FIG. 5 is an enlarged view of the region V enclosed by the dashed line in FIG. 4.
Figure 6:
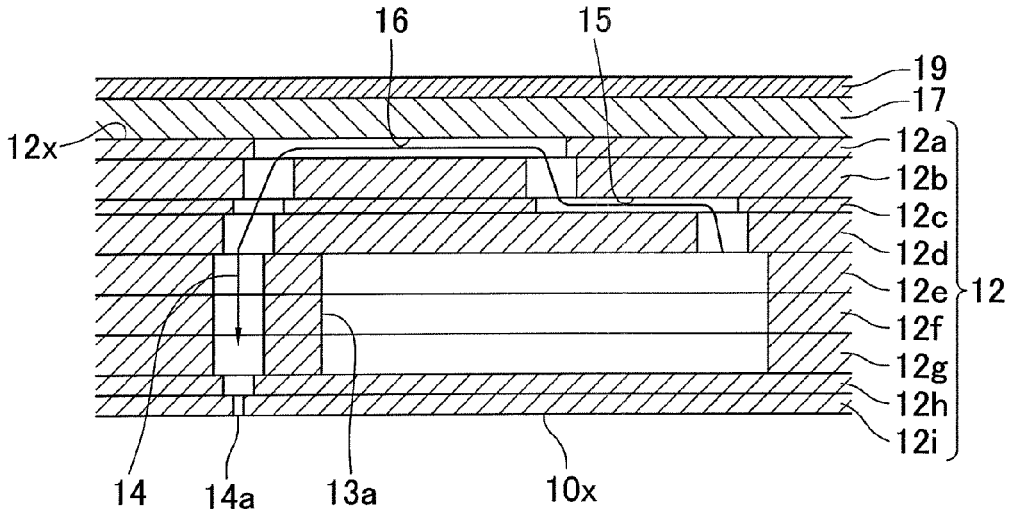
FIG. 6 is a partial cross section taken along the V1-V1 line in FIG. 5.

Now, referring to FIG. 4 to FIG. 6, the arrangement of the heads 10*a* and 10*b* will be detailed.

Each of the heads 10*a* and 10*b* includes members such as a reservoir unit and a passage unit 12 which are vertically piled up, eight actuator units 17 fixed to the upper surface 12*x* of the passage unit 12, and an FPC (flat flexible circuit board) 19 connected to each actuator unit 17. In the reservoir unit, a passage including a reservoir which temporarily stores liquid supplied from the corresponding container of the cartridge 2 is formed. In the passage unit 12, a passage from the opening 12*y* of the upper surface 12*x* to each ejection opening 14*a* of the lower surface (ejection surface 10*x*) is formed. The actuator unit 17 includes a piezoelectric actuator for each ejection opening 14*a*.

The lower surface of the reservoir unit has concaves and protrusions. Each of the protrusions is adhered to a region (enclosed by a two-dot chain line and including an opening 12*y* shown in FIG. 4) which is on the upper surface 12*x* of the passage unit 12 and where no actuator unit 17 is disposed. The leading end surface of the protrusion has an opening which is connected to the reservoir and opposes each opening 12*y* of the passage unit 12. With this, the reservoir is connected to individual passages 14 via each opening above. The concave portion opposes the upper surface 12*x* of the passage unit 12, the surface of the actuator unit 17, and the surface of the FPC 19, with a slight gap being formed therebetween.

The passage unit 12 is a laminated body formed by laminating nine rectangular metal plates 12*a*, 12*b*, 12*c*, 12*d*, 12*e*, 12*f*, 12*g*, 12*h*, and 12*i* which are substantially identical in size and by adhering the plates with one another (see FIG. 6). The passage in the passage unit 12 includes a manifold passage 13 having an opening 12*y* at one end, a sub-manifold passage 13*a* branching from the manifold passage 13, and an individual passage 14 which connects the outlet of the sub-manifold passage 13*a* with the ejection opening 14*a* via the pressure chamber 16. The individual passage 14 is formed for each ejection opening 14*a* and includes an aperture 15 which is an aperture for adjusting the flow resistance. At the region on the upper surface 12*x* to which region each actuator unit 17 is adhered, substantially diamond-shaped openings are formed in a matrix manner to expose the pressure chambers 16. At a region on the lower surface (ejection surface 10*x*) which region opposes the region to which each actuator unit 17 is adhered, ejection openings 14*a* are formed in a matrix manner and in the same arrangement as the pressure chambers 16.

In connection with the above, in FIG. 5, the pressure chambers 16 and the apertures 15 are depicted by full lines even if they are underneath the actuator unit 17.

The actuator units 17 are each trapezoidal in plan view and are staggered on the upper surface 12*x* of the passage unit 12 to form two lines. Each actuator unit 17 covers a plurality of openings of the pressure chambers 16, which are formed in the region where the actuator unit 17 is adhered. Although not illustrated, the actuator unit 17 is constituted by a piezoelectric layer, a diaphragm, a common electrode, and individual electrodes. Among these members, the piezoelectric layer, the diaphragm, and the common electrode are all trapezoidal and sized to define the outer shape of the actuator unit 17. The individual electrodes are provided for the respective pressure chambers 16 and are disposed on the upper surface of the piezoelectric layer to oppose the respective pressure chambers 16. The diaphragm is disposed between the common electrode and the passage unit 12. A part of the actuator unit 17 which part corresponds to each individual electrode functions as a piezoelectric actuator. Each actuator is independently deformable in response to the application of a voltage via the FPC 19. The actuator changes the capacity of the corresponding pressure chamber 16 to provide an energy to the liquid in the pressure chamber 16. With this, the liquid is ejected through the ejection opening 14*a*.

The FPC 19 is provided with a driver IC and wires which correspond to the respective electrodes of the actuator unit 17. The FPC 19 is fixed to the actuator unit 17 at one end and fixed to the control substrate of the head 10*a* or 10*b* at the other end. The control substrate adjusts a signal supplied from the controller 1*p* and inputs the adjusted signal to the driver IC via the wire of the FPC 19. The driver IC converts the signal input from the control substrate to a drive signal and sends the drive signal to each electrode of the actuator unit 17 via the wire of the FPC 19.

Now, referring to FIG. 7A to FIG. 9, the arrangement of the capping mechanism 40, the arrangement of the moisturizing unit 50, the arrangement of the wiper unit 36, the operations in the maintenance, or the like will be described below.

The annular member 41 is connected with a plurality of gears 43 (see FIG. 9), and moves up or down as the gears 43 are rotated by an annular member elevating motor 41M (see FIG. 11) under the control of the controller 1*p*.

The opposing member 42 is connected to the opposing member elevating motor 42M (see FIG. 11) and moves up or down by the opposing member elevating motor 42M under the control of the controller 1*p*. The opposing member 42 takes one of a first position, a second position, a third position, and a fourth position (see FIG. 7A and FIG. 7B). The first position is the highest, the second position is the second highest, the third position is the third highest, and the fourth position is the lowest.

The opposing member 42 is at the first position when the capping or flushing is conducted. The opposing member 42 is at the second position When the opposing surface 42*a* (which is the surface of the opposing member 42 and opposes the ejection surface 10*x* when the platens 6*a* and 6*b* are at the open position) is wiped. The opposing member 42 is at the third position when the wiping or purging of the ejection surface 10*x* is conducted. The opposing 5, member 42 is at the fourth position when the recording is conducted or the apparatus is on standby. The separation distance between the opposing surface 42*a* and the ejection surface 10*x* when the opposing member 42 is at the first position is identical with the separation distance between the supporting surface 5*a* and the ejection surface 10*x* at the time of the recording.

Figure 7A:
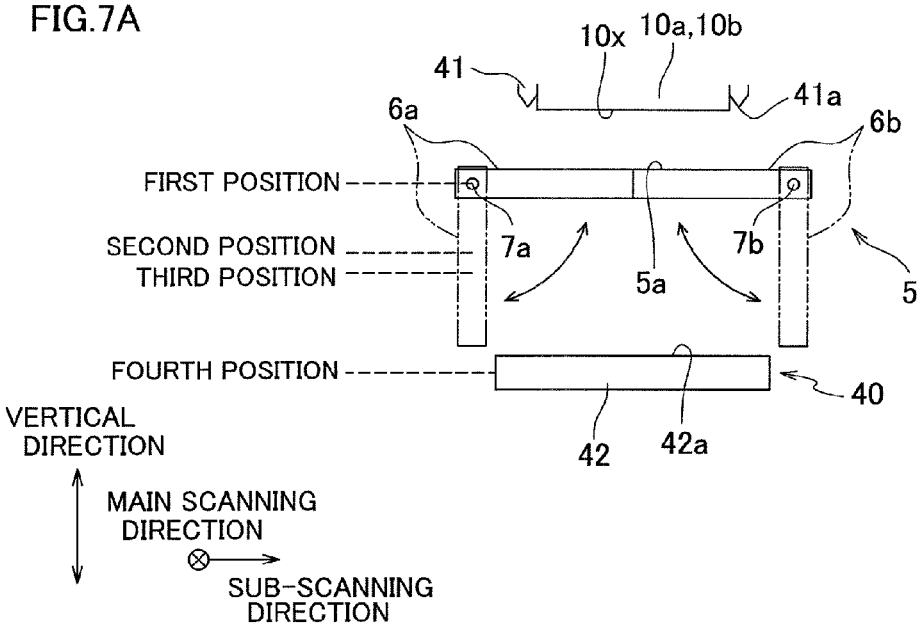
FIG. 7A and FIG. 7B illustrate the operations of a capping mechanism and a supporting mechanism.
Figure 7B:
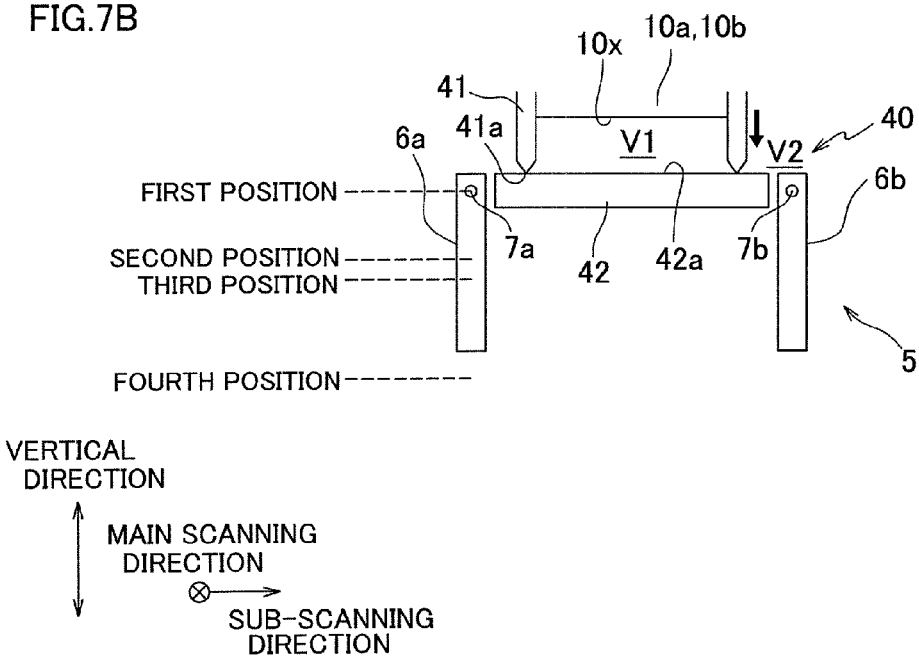

The capping mechanism 40 selectively takes a capped state (see FIG. 7B and FIG. 9) or an uncapped state (see (FIG. 2 and FIG. 7A). In the capped state, the ejection space V1 opposing the ejection surface 10*x* of the corresponding head 10*a* or 10*b* is covered, and separated from the space V2 which surrounds the ejection space V1, At the uncapped state, the ejection space V1 opposing the ejection surface 10*x* of the corresponding head 10*a* or 10*b* is not covered, and open to the space V2 surrounding the ejection space V1, The capping is an operation to maintain the capping mechanism 40 to be in the capped state. To change the state of the capping mechanism 40 to the capped state, as shown in FIG. 7B, the controller 1*p* moves down the annular member 41 while the supporting mechanism 5 is set at the Open position and the opposing member 42 is set at the first position. As a result, the leading end 41*a* of the annular member 41 contacts the opposing surface 42*a* and hence the closed ejection space V1 is formed between the opposing surface 42*a* and the ejection surface 10*x*. The capping is conducted when; for example, no recording command is received for at least a predetermined time. By the capping, the drying of the ejection space V1 is prevented and the increase in the viscosity of the liquid in the ejection opening 14*a* is restrained.

The flushing is an operation to discharge liquid through the ejection opening 14*a* by driving the actuator unit 17 based on flushing data which is different from recording data (image data), The purging is an operation to discharge liquid through the ejection opening 14*a* by supplying the liquid to the head 10*a* or 10*b* by using a pump 2Pa, 2Pb (see FIG. 11) and then applying a pressure to the liquid in the head 10*a* or lob. The flushing and the purging are conducted when no liquid is ejected through the ejection opening 14*a* for at least a predetermined time (the predetermined time may be different between the flushing and the purging). By the flushing or the purging, liquid with increased viscosity in the ejection opening 14*a* and liquid contaminated with foreign matters (dust, bubbles or the like) are discharged and the ejection properties are restored.

When the flushing is conducted, the controller 1*p* sets the supporting mechanism 5 at the open position and sets the opposing member 42 at the first position, and drives the actuator unit 17 of the head 10*a* or 10*b* while the leading end 41*a* of the annular member 41 is positioned either at the same height as the ejection surface 10*x* or vertically above the ejection surface 10*x*. When the purging is conducted, the controller 1*p* sets the supporting Mechanism 5 at the open position and sets the opposing member 42 at the third position, and drives the pump 2Pa, 2Pb while the leading end 41*a* of the annular member 41 is either at the same height as the ejection surface 10*x* or vertically above the ejection surface 10*x*. The liquid discharged on account of the flushing or the purging is received by the opposing surface 42*a*.

The wiping is an operation to remove a foreign matter on a target by causing a wiper to contact the target and moving the wiper relative to the target. The wiping is conducted by using a wiper unit 36 (see FIG. 8A to FIG SC). There are two types of the wiping, namely, the wiping of the ejection surface 10*x* and the wiping of the opposing surface 42*a*. For example, the wiping of the ejection surface 10*x* is conducted after the completion of the purging, whereas the wiping of the opposing surface 42*a* is conducted after the wiping of the ejection surface 10*x* after the completion of the purging, and also after the completion of the flushing.

The wiper unit 36 includes two wipers 36*a* and 36*b* and a base portion 36*c* supporting the wipers 36*a* and 36*b*. The wipers 36*a* and 36*b* are both plate-shaped members made of an elastic member (such as rubber), and protrude upward and downward from the upper surface and the lower surface of the base portion 36*c*, respectively, In the sub-scanning direction, the wiper 36*a* is slightly longer than the length of the ejection surface 10*x* and the wiper 36*b* is slightly longer than the length of the opposing surface 42*a*. The base portion 36*c* is connected to a wiper drive motor 36M (see FIG. 11), and is able to be reciprocated in the main scanning direction along the guide hole 36*g* by the wiper drive motor 36M under the control of the controller 1*p*. The home position of the base portion 36*c* is to the left of the heads 10*a* and 10*b* in FIG. 8A (i.e., the position where the base portion 36*c* is provided in FIG. 8A).

Figure 8B:
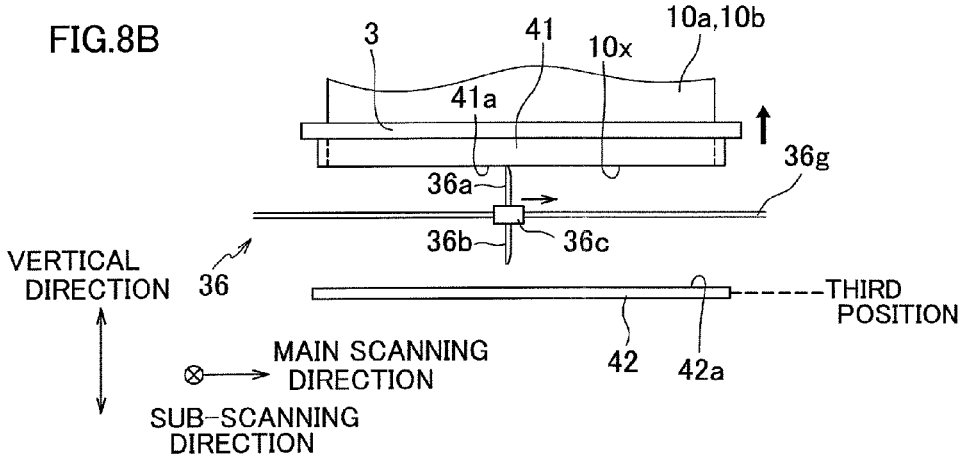
FIG. 8B and FIG. 8C illustrate wiping.
Figure 11:
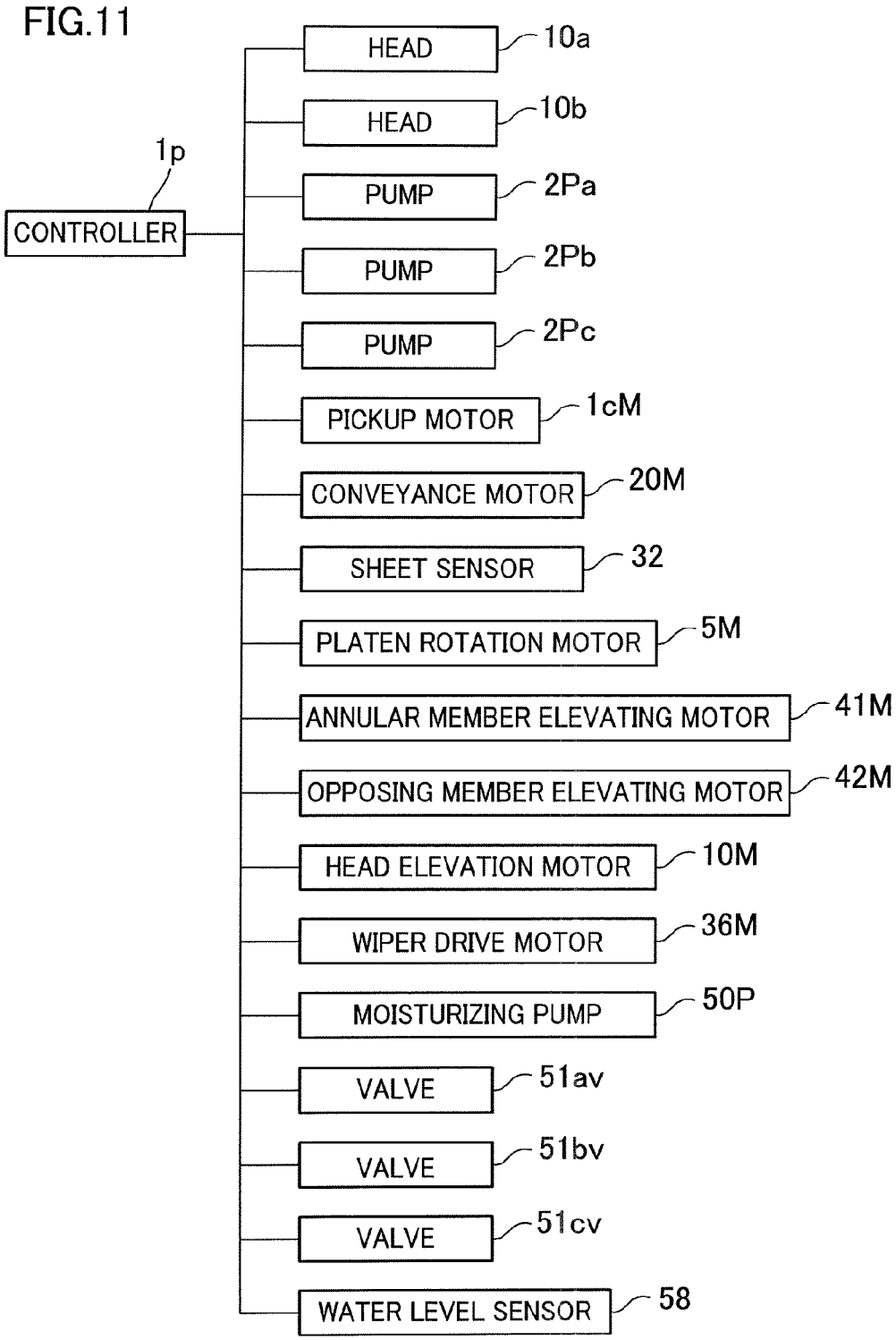
FIG. 11 is a block diagram of the electric configuration of the printer.

When the wiping of the ejection surface 10*x* is conducted, as shown in FIG. 8B, the controller 1*p* moves up the heads 10*a* and lob together with the holder 3 by driving a head elevation motor 10M (see FIG. 11). The controller 1*p* then positions the, supporting mechanism 5 at the open position and positions the opposing member 42 at the third position, and drives the wiper drive motor 36M while the leading end 41*a* of the annular member 41 is at the same height as the ejection surface 10*x* or vertically above the ejection surface 10*x*. With this, the base portion 36*c* moves rightward in FIG. 8B from the home position and a part of the wiper 36*a* around its leading end moves relative to the ejection surface 10*x* while contacting the ejection surface 10*x*. As a result, foreign matters on the ejection surface 10*x* are removed. To conduct the wiping of the opposing surface 42*a* subsequent to the wiping of the ejection surface 10*x*, the controller 1*p* causes the base portion 36*c* to be on standby at a position to the right Of the heads 10*a* and 10*b* in FIG. 8B.

Figure 8C:
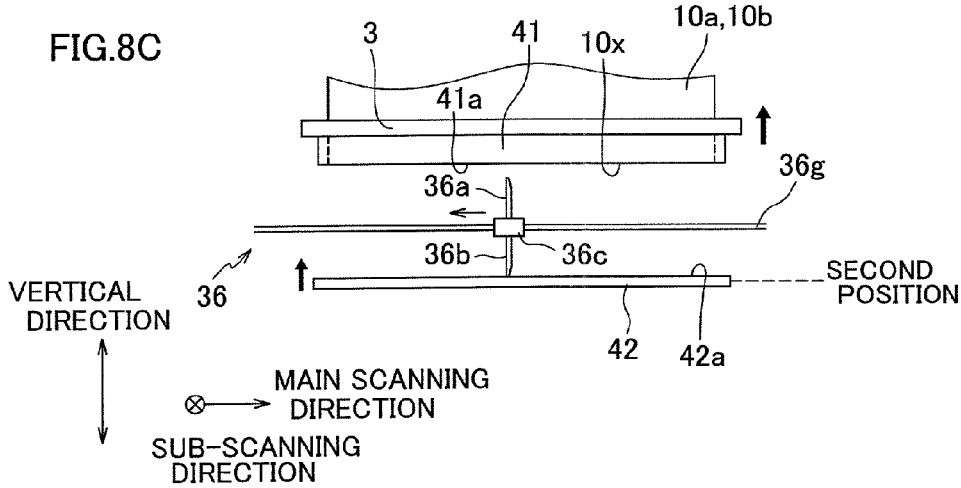

To conduct the wiping of the opposing surface 42*a*, as shown in FIG. 8C, the controller 1*p* moves up the heads 10*a* and 10*b* together with the holder 3 by driving a head elevation motor 10M (see FIG. 11), so as to position the heads 10*a* and 10*b* to be vertically above the position in the wiping of the ejection surface 10*x* shown in FIG. 8B. The controller 1*p* then positions the supporting mechanism 5 at the open position and positions the opposing member 42 at the second position, and drives the wiper drive motor 36M while the leading end 41*a* of the annular member 41 is at the same height as the ejection surface 10*x* or is vertically above the ejection surface 10*x*. With this, a part of the wiper 36*b* around its leading end moves relative to the opposing surface 42*a* while contacting the opposing surface 42*a*. As a result, foreign matters on the opposing surface 42*a* are removed.

To conduct the wiping of the opposing surface 42*a* subsequent to the wiping of the ejection surface 10*x*, the controller 1*p* moves the base portion 36*c* leftward as shown in FIG. 8C and stops it at the home position. With this movement, the opposing surface 42*a* is wiped. On the other hand, in cases other than the above, the controller 1*p* moves the base portion 36*c* rightward from the home position in FIG. 8C and stops it at a position to the right of the heads 10*a* and 10*b*. With this movement, the opposing surface 42*a* is wiped. After moving the opposing member 42 to the fourth position, the controller 1*p* moves the base portion 36*c* leftward in FIG. 8C and stops it at the home position.

The moisturization operation is an operation to moisturize the ejection space. V1 by driving a moisturizing pump 50P (see FIG. 9) of the moisturizing unit 50 while keeping the capping mechanism 40 to take the capped state. The moisturization operation is, for example, periodically conducted while the capping is maintained. By the moisturization operation, moisturized air is supplied into the ejection space V1 and hence the increase in the viscosity of the liquid in the ejection opening 14*a* is restrained.

The moisturizing unit 50 includes a tank 51 which stores moisturizing liquid, two tubes 52*a*, two tubes 52*c*, and a moisturizing pump 50P. Each of the two tubes 52*a* connects the tank 51 with a joint 48 of the head 10*a* or 10*b*, and has an inflow path 52*a*1 therein. The inflow path 52*af* connects a space 51V in the tank 51 with the ejection space V1 when the capping mechanism 40 is in the capped state, and air flowing out from the ejection space V1 towards the tank 51 passes through the inflow path 52*af*. Each of the two tubes 52*c* connects the tank 51 with a joint 49 of the head 10*a* or 10*b* and has an outflow path 52*cf* therein. The outflow path 52*cf* connects the space 51V with the ejection space V1 when the capping mechanism 40 is in the capped state, and air flowing out from the tank 51 towards the ejection space V1 passes through the outflow path 52*cf* The two joints 48 and 49 are provided for, each of the heads 10*a* and 10*b*, and are disposed at One end and the other end of each of the heads 10*a* and 10*b* in the main scanning direction. The joints 48 and 49 are attached to the annular member 41, Each of the joints 48 and 49 is substantially cylindrical and connects the ejection space V1 with the space surrounding the ejection space V1 by the internal space of the same. The moisturizing pump 50P is disposed on a non-edge part of each tube 52*c*.

On the upper surface of the tank 51 is provided protruding portions 51*a*, 51*b*, and 51*c* which are cylindrical in shape and protrude upward. At the leading ends of the two protruding portions 51*a*, the tubes 52*a* are attached, respectively. At the leading ends of the two protruding portions 51*c*, the tubes 52*c* are attached, respectively. The proximal ends of the protruding portions 51*a* and 51*c* are open to the space 51V via through holes made through the upper wall of the tank 51. The protruding portion 51*b* is connected to a cylindrical member 51*b*2 which protrudes downward in the tank 51. The internal spaces of the protruding portion 51*b* and the cylindrical member 51*b*2 are connected with each other via a through hole made through the upper wall of the tank 51, so as to form an atmosphere connection path 51*bf* which connects the space 51V with the atmosphere.

Around the protruding portion 51*a* of each tube 52*a* is provided a valve 52*av* which opens or closes the inflow path 52*af*. Around the protruding portion 51*e* of each tube 52*c* is provided a valve 52*cv* which opens or closes the outflow path 52*cf*. Around the upper end of the protruding portion 51*b* is provided a valve 51*bv* which opens or closes the atmosphere connection path 51*bf*. These valves 51*bv*, 52*av*, and 52*ev* are opened or closed under the control of the controller 1*p*.

Figure 9:
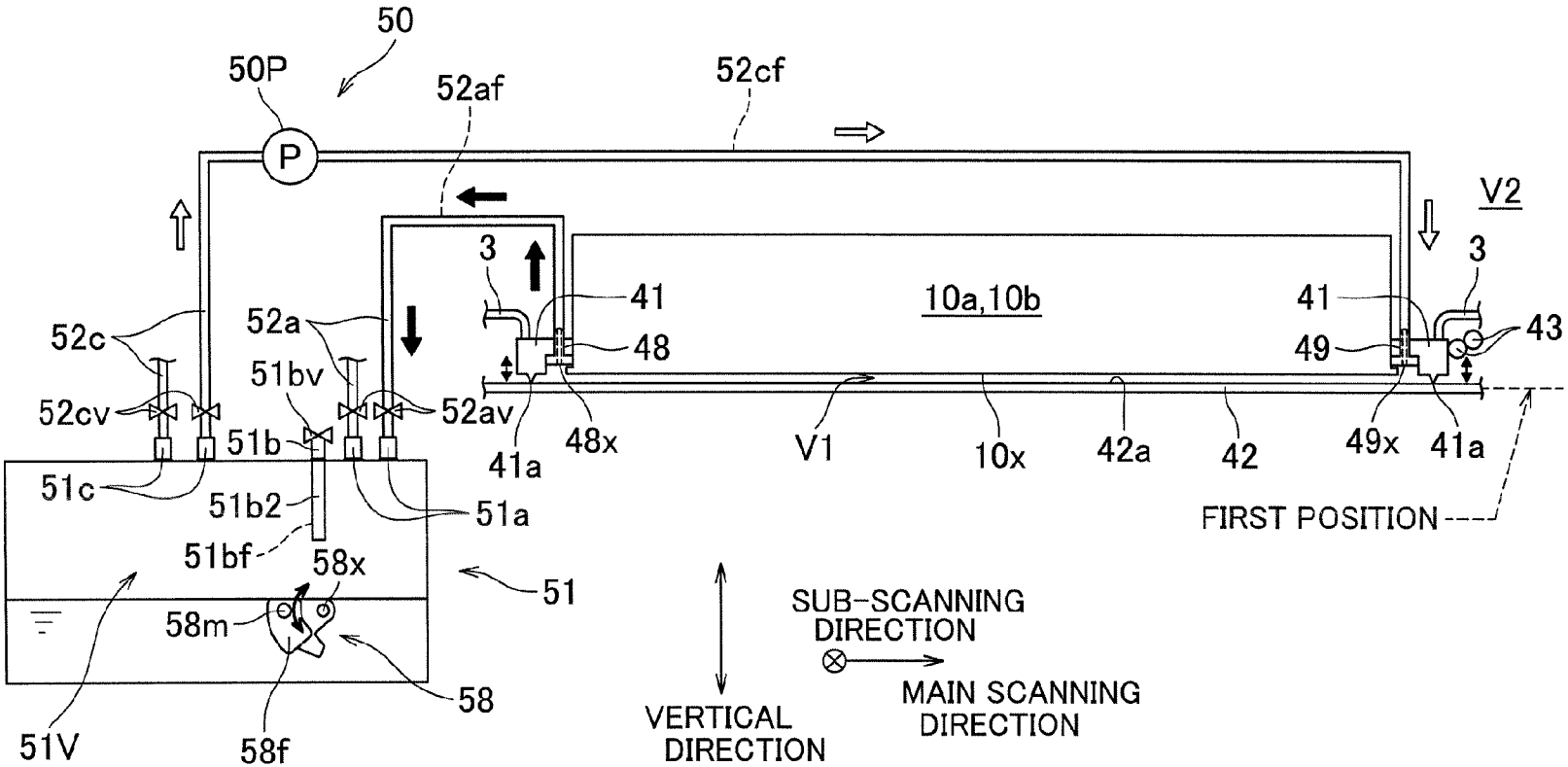
FIG. 9 illustrates a moisturization operation.

To conduct the moisturization operation, the controller 1*p* sets the capping mechanism 40 in the capped state and drives the moisturizing pump 50P while keeping the valves 51*bv*, 52*av*, and 52*cv* to be open. As s result, the air in the ejection space V1 is collected through an opening 48*x* on the lower surface of the joint 48, passes through the inflow path 52*af* in the tube 52*a*, and eventually flows into the space 51V. The air having flown into the space 51V is moisturized by (the natural evaporation of) the moisturizing liquid stored in the space 51V, and then passes through the outflow path 52*cf* in the tube 52*c* and reaches the ejection space V1 via an opening 49*x* on the lower surface of the joint 49. In FIG. 9, black arrows indicate the flow of air before the moisturization, whereas outline arrows indicate the flow of air after the moisturization.

In addition to the above, the controller 1*p* closes the valves 51*bv*, 52*av*, and 52*ev* when the capping mechanism 40 is in the uncapped state, and opens the valve 51*bv*, 52*av*, and 52*cv* when the capping mechanism 40 is in the capped state and the moisturizing pump 50P is not driven. Furthermore, the controller 1*p* is able to control the moisturizing pump 50P such that the airflow produced by the moisturizing pump 50P is reversed to cause'the air flowing out from the ejection space V1 towards the tank 51 to pass through the outflow path 52*cf* and to cause the air flowing out from the tank 51 towards the ejection space V1 to pass through the inflow path 52*af*.

The tank 51 is provided with a water level sensor 58 which detects the water level of moisturizing liquid. The water level sensor 58 includes a float 58*f* and a magnetic sensor (not illustrated) which detects the existence of a magnet 58*m* fixed to the float 58*f*. The float 58*f* is swingable about a shaft 58*x* fixed to a side wall of the tank 51. As air is enclosed therein, the float 58*f* swings to follow the movement of the surface of the moisturizing liquid. The magnetic sensor detects whether the position of the magnet 58*m* is at the position indicating the maximum water level of the tank 51. Before conducting the moisturization operation, based on a detection signal from the water level sensor 58, the controller 1*p* drives a pump 2Pc (see FIG. 11) to supply the moisturizing liquid from the moisturizing liquid container of the cartridge 2 to the space 51V so that the water level of the moisturizing liquid stored in the space 51V is at the maximum (as shown in FIG. 10B), when the moisturizing liquid stored in the space 51V is not at the maximum water level.

Figure 10A:
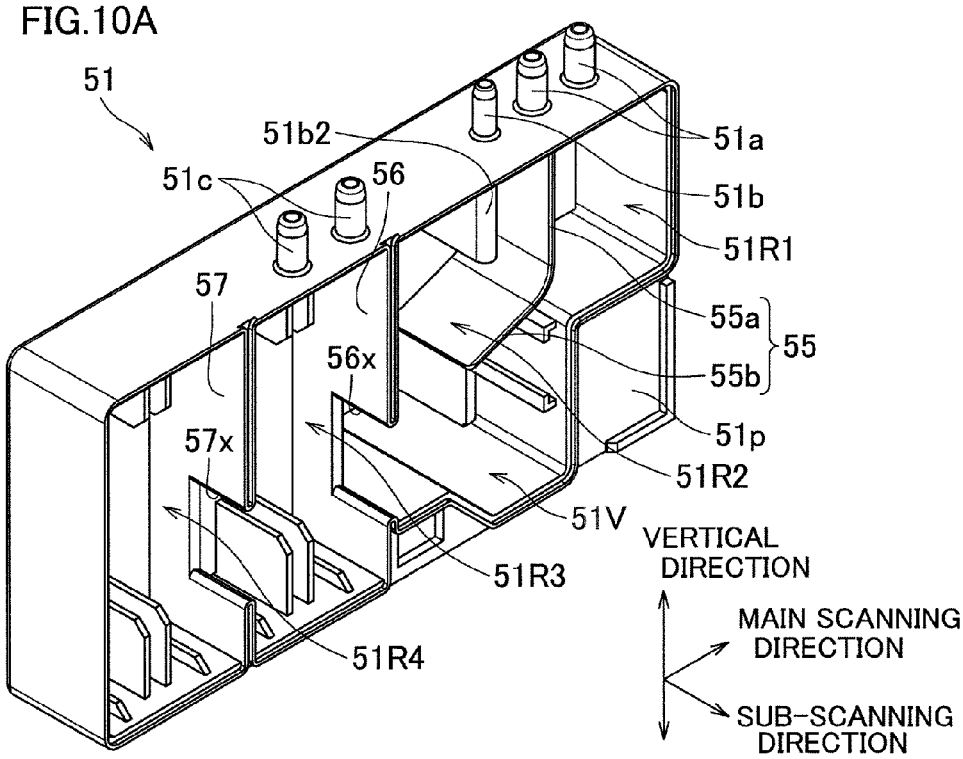
FIG. 10A is an oblique perspective of a tank in a moisturizing unit.
Figure 10B:
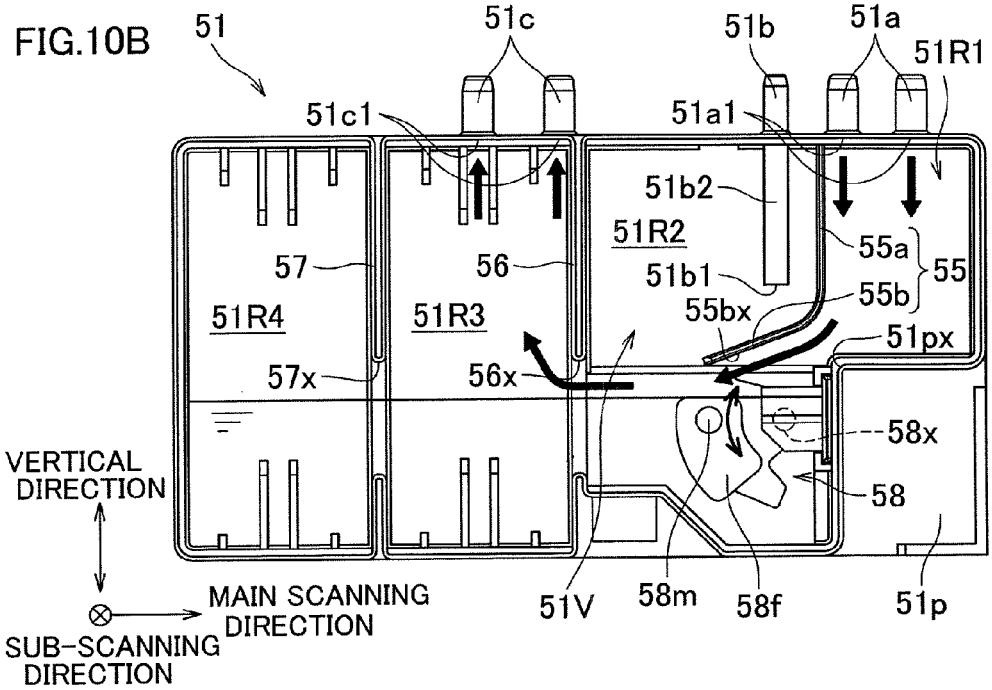
FIG. 10B is a schematic profile of the tank.

Now, referring to FIG, 10A and FIG. 10B, the arrangement of the tank 51 and the airflow in the space 51V will be detailed. In FIG. 10A and FIG. 10B, one side wall of the tank 51 is not shown for easy explanation of the arrangement inside the tank 51.

The tank 51 is a housing which is substantially: rectangular parallelepiped in shape. The space 51V is divided into four chambers 51R1, 51R2, 51R3, and 51R4 by a flow adjuster 55 and partitions 56 and 57. The flow adjuster 55 separates the chamber 51R1 from the chamber 51R2, the partition 56 separates the chamber 51R2 from the chamber 51R3, and the partition 57 separates the chamber 51R3 from the chamber 51R4. An opening (inflow opening) 51*a*1 at the proximal end of the protruding portion 51*a* is disposed in the chamber 51R1, an opening (atmosphere opening) 51*b*1 at the lower end of the cylindrical member 51*b*2 is disposed in the chamber 51R2, and an opening (outflow opening) 51*c*1 at the proximal end of the protruding portion 51*e* is disposed in the chamber 51R3. The chambers 51R1 to 51R4 are lined up in the main scanning direction in this order. Because the protrusion 51*p* vertically below the chamber 51R1 is substantially identical in size with the chamber 51R1, the chamber 51R1 is smaller than the other chambers 51R2 to 51R4 and is about identical in size with the upper half of the chamber 51R3. The moisturizing liquid is stored in lower parts of the chambers 51R2 to 51R4. The inflow opening 51*a*1 and the, outflow opening 51*c*1 are disposed vertically above the maximum water level (shown in FIG. 10B) of the moisturizing liquid.

The flow adjuster 55 is a bended plate and includes a vertical part 55*a* and an inclined part 55*b*. The upper end of the vertical part 55*a* is fixed to the upper wall of the tank 51 and is between two protruding portions 51*a* and one protruding portion 51*b*. The vertical part 55*a* protrudes vertically downward from the upper wall of the tank 51 in the same manner as the cylindrical member 51*b*2 and is substantially identical in length with the cylindrical member 51*b*2. The inclined part 55*b* extends, from the lower end of the vertical part 55*a*, in a direction inclined from the vertical direction (i.e., leftward and downward in FIG. 10B), which is formed by a direction component running from the inflow opening 51*a*1 toward the outflow opening 51*c*1 (i.e. leftward in FIG. 10B) and a direction component running vertically downward. The inclined part 55*b* covers the atmosphere opening 51*b*1 from below. The flow adjuster 55 has, at its lower end, a slope 55*bx* (lower surface of the inclined part 55*b*) which is inclined in a direction formed by a direction component running from the inflow opening 51*a*1 toward the outflow opening 51*c*1 (leftward in FIG. 10B) and a direction component running vertically downward. The flow adjuster 55 is disposed vertically above the maximum water level (shown in FIG. 10B) of the moisturizing liquid.

The partitions 56 and 57 are flat plates which vertically connect the upper wall of the tank 51 with the lower wall of the tank 51. The partitions 56 and 57 have, at their side faces, rectangular notches 56*x* and 57*x*, respectively. The notches 56*x* and 57*x* are formed in regions including the maximum water level (shown in FIG. 10B) of the moisturizing liquid. The upper end of the partition 56 is disposed between the two protruding portions 51*c* and one protruding portion 51*b*. The partition 57 is disposed on the side opposite to the flow adjuster 55 over the partition 56 in the main scanning direction.

The flow adjuster 55 and the partitions 56 and 57 are fixed to a pair of side walls of the tank 51. The paired side walls extend in directions in parallel to the surface of FIG. 10B and oppose each other in the direction vertical to the surface of FIG. 10B. One of the paired side walls, which is not shown in FIG. 10A and FIG 10B, may be a thin film.

The flow of air in the space 51V is indicated by thick arrows in FIG. 10B. The air having flown into the space 51V through each inflow opening 51*a*1 moves down in the chamber 51R1 and then moves to the chamber 51R2 along the bended shape of the flow adjuster 55. In so doing, the air passes through a relatively narrow space between a corner 51*px* of, the protrusion 51*p* and a slope 55*bx*, and moves leftward and downward in FIG. 10B while increasing the flew velocity in the space. The air then moves along the surface of the moisturizing liquid in the chamber 51R2, passes through a space between the upper wall of the partition 56 which defines the notch 56*x* and the surface of the moisturizing liquid, and then reaches the chamber 51R3. The air having reached the chamber 51R3 moves upward and flows out from the space 51V through each outflow opening 51*e*1.

As such, the air having flown into the space 51V through each inflow opening 51*a*1 is guided by the flow adjuster 55 and a part of the partition 56 which part is vertically above the notch 56*x* toward the outflow opening 51*c*1 along the surface of the moisturizing liquid. The air then flows out from the space 51V towards the outflow path 52*cf* through each outflow opening 51*c*1 without passing through the moisturizing liquid stored in the space 51V.

It is noted that the chamber 51R4 is not a space in which the air actively flows during the moisturization operation but a space which receives the moisturizing liquid when the tank 51 is tilted on account of, for example, the movement of the printer 1.

As described above, in the printer 1 of the present embodiment because both the inflow Opening 51*a*1 and the outflow opening 51*c*1 are positioned vertically above the surface of the moisturizing liquid stored in the space 5W, the generation of bubbles and splash droplets of the moisturizing liquid in the tank is restrained and hence the destruction of the meniscus is restrained.

The flow adjuster 55 and the part of the partition 56 vertically above the notch 56*x* are disposed vertically above the surface of the moisturizing liquid, between the inflow opening 51*a*1 and the outflow opening 51*c*1 . According to this arrangement, on account of the members 55 and 56, the airflow along the surface of the moisturizing liquid is formed. In the tank 51, a relatively high humidity is attained around the surface of the moisturizing liquid, and moisturization by the natural evaporation of the moisturizing liquid is easily achieved by the contact with the moisturizing liquid. As the air is guided to this highly humid part, the moisturization is efficiently carried out.

By the slope 55*bx* of the flow adjuster 55, the air having flown into the space 51V through the inflow opening 51*a*1 is smoothly guided to the vicinity of the surface of the moisturizing liquid and to the outflow opening 51*c*1.

The path of the air having flown into the space 51V through the inflow opening 51*a*1 which is defined by the flow adjuster 55, is narrowed by the slope 55*bx*. According to this arrangement, because the flow velocity of the air increases at the slope 55*bx*, the air is further smoothly guided to the vicinity of the surface of the moisturizing liquid.

By the partition 56, the space 51V is divided into spaces such as the space where the inflow opening 51*a*1 is disposed, the space where the outflow opening 51*e*1 is disposed, and the space where the atmosphere opening 51*b*1 is disposed, and the air is guided to the vicinity, of the moisturizing liquid.

The partition 56 is fixed to both of the paired side walls of the tank 51, so that the rigidity of the tank 51 is improved.

The atmosphere opening 51*b*1 is disposed between the inflow opening 51*a*1 and the outflow opening 51*c*1. With this, even if the tank 51 is tilted on account of, for example, the movement of the printer 1, the moisturizing liquid does not easily flows into the atmosphere opening 51*b*1.

In the vertical direction, the flow adjuster 55 is interposed between the atmosphere opening 51*b*1 and the surface of the moisturizing liquid. According to this arrangement, on account of the presence of the flow adjuster 55, it is possible to certainly restrain the moisturizing liquid from flowing into the atmosphere opening 51*b*1.

When the capping mechanism 40 is in the uncapped state, the controller 1*p* controls the valves 51*bv*, 52*av*, and 52*ev* so that the inflow path 52*af*, the outflow path 52*cf*, and the atmosphere connection path 51*bf* are closed. According to this arrangement, it is possible to prevent the moisturizing liquid in the tank 51 from being decreased for the reason that the liquid having been evaporated in the tank 51 flows out from the tank 51.

When the capping mechanism 40 is in the capped state and the moisturizing pump 50P is not driven, the controller 1*p* controls the valves 51*bv*, 52*av*, and 52*cv* so that the inflow path 52*af*, the outflow path 52*cf*, and the atmosphere connection path 51*bf* are opened. This arrangement makes it possible to maintain the pressure in the ejection space V1 to be identical with the atmospheric pressure. With this, the destruction of the meniscus on account of a change in the pressure in the ejection space V1 and liquid leakage through the ejection opening 14*a* are restrained.

When the capping mechanism 40 is in the capped state and the moisturizing pump 50P is driven, the controller 1*p* controls the valves 51*bv*, 52*av*, and 52*cv* so that the inflow path 52*af*, the outflow path 52*cf*, and the atmosphere connection path 51*bf* are opened. This arrangement makes it possible to maintain the pressure in the ejection space V1 to be identical with the atmospheric pressure. With this, the destruction of the meniscus on account of a change in the pressure in the ejection space V1 and liquid leakage through the ejection opening 14*a* are restrained.

Now, referring to FIG. 12, an inkjet printer according to Second Embodiment of the present invention will be described. The printer of the present embodiment is substantially identical with the printer 1 of the First Embodiment except the structure of the tank. Elements which are the same as those of First Embodiment are designated by the same reference numerals, and redundant descriptions thereof are omitted.

In the present embodiment, a space 251V in a tank 251 is divided into three chambers 251R1, 251R2, and 251R3 by two flow adjusters 255 and 256. The chambers 251R1 and 253R are smaller than the chamber 251R2, i.e., more or less identical with an upper half of the chamber 251R2 in size, because protrusions 51*p* and 251*p* which are substantially identical in size with the chambers 251R1 and 251R3 are disposed vertically below the chambers 251R1 and 253R. The moisturizing liquid is stored in a lower part of the chamber 251R2.

The flow adjusters 255 and 256 are bended plates in the same manner as the flow adjuster 55 of the First Embodiment, and include vertical parts 255*a* and 256*a* and inclined parts 255*b* and 256*b*, respectively. Each of the vertical parts 255*a* and 256*a* extends vertically downward from the upper wall of the tank 251 in the same manner as the vertical part 55*a* of First Embodiment. The inclined part 255*b* extends in a direction formed by a direction component running from the inflow opening 51*a*1 toward the outflow Opening 51*c*1 (leftward in FIG. 12) and a direction component running vertically downward, in the same manner as the inclined part 55*b* of First Embodiment. In the meanwhile, the inclined part 256*b* extends in a direction formed by a direction component running from the outflow opening 5101 toward the inflow opening 51*a*1 (rightward in FIG. 12) and a direction component running vertically downward.

When viewed in the sub-scanning direction, the flow adjusters 255 and 256 are symmetrically arranged about the center line of the tank 251. Furthermore, the air path in a space 251V formed by the outer wall of the tank 251 and the flow adjusters 255 and 256 is symmetrical in shape about the center line of the tank 251, when viewed in the sub-scanning direction. The center line extends in the vertical direction while passing through the center of the tank 251 with respect to the main scanning direction.

The flow adjuster 255 has, at its lower end, a slope (lower surface of the inclined part 255*b*) 255*bx* which is inclined in a direction formed by a direction component running from the inflow opening 51*a*1 toward the outflow opening 51*c*1 (leftward in FIG. 12) and a direction component running vertically downward. The flow adjuster 256 has, at its lower end, a slope (lower surface of the inclined part 256*b*) 256*bx* which is inclined in a direction formed by a direction component running from the outflow opening 5161 toward the inflow opening 51*a*1 (rightward in FIG. 12) and a direction component running vertically downward. The flow adjusters 255 and 256 are disposed vertically above the maximum water level (shown in FIG. 12) of the moisturizing liquid, between the inflow opening 51*a*1 and the outflow opening 51*c*1.

Figure 12:
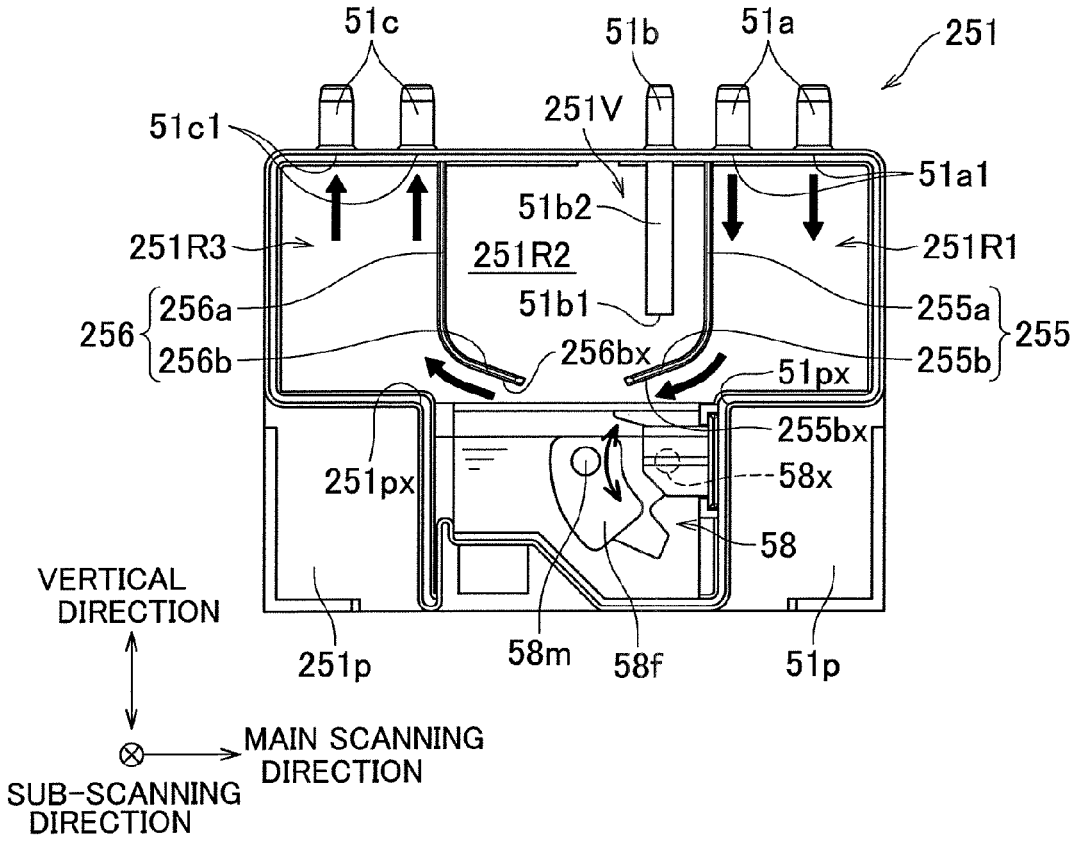
FIG. 12 is a schematic profile of a tank in a moisturizing unit of an inkjet printer according to Second Embodiment of the present invention.

The airflow in the space 251V is indicated by thick arrows in FIG. 12. The air having flown into the space 251V through each inflow opening 51*a*1 moves down in the chamber 251R1 and then moves to the chamber 251R2 along the bended shape of the flow adjuster 255. In so doing, the air passes through a relatively narrow space between a corner 51*px* of the protrusion 51*p* and a slope 255*bx*, and moves leftward and downward in FIG. 12 while increasing the flow velocity in the space. The air then moves along the surface of the moisturizing liquid in the chamber 251R2, passes through a relatively narrow space between the corner 251*px* of the protrusion 251*p* and the slope 256*bx* while increasing the flow velocity in this space, and then moves leftward and upward in FIG. 12 and reaches the chamber 251R3. The air having reached the chamber 251R3 moves upward and flows out from the space 251V through each outflow opening 51*c*1.

As such, the air having flown into the space 251V through each inflow opening 51*a*1 is guided by the flow adjusters 255 and 256 along the surface of the moisturizing liquid toward the outflow opening 51*c*1. The air then flows out from the space 251V towards the outflow path 52*cf* through each outflow opening 51*c*1 without passing through the moisturizing liquid stored in the space 251V.

When the flow of the air generated by the moisturizing pump 50P is reversed, the airflow in the space 251V in the tank 251 becomes in reverse to the direction indicated by the thick arrows in FIG. 12. That is to say, the air having flown into the space 251V through each, outflow opening 51*c*1 moves down in the chamber 251R3 and then moves to the chamber 251R2 along the bended shape of the flow adjuster 256. In so doing, the air passes through a relatively narrow space between a corner 251*px* of the protrusion 251*p* and a slope 256*bx*, and moves rightward and downward in FIG. 12 while increasing the flow velocity in the space; The air then moves along the surface of the moisturizing liquid in the chamber 251R2, passes through a relatively narrow space between the corner 51*px* of the protrusion 51*p* and the slope 255*bx* while increasing the flow velocity in this space, and then moves rightward and upward in FIG. 12 and reaches the chamber 251R1. The air having reached the chamber 251R1 moves upward and flows out from the space 251V through each inflow opening 51*a*1.

In the case above, the air having flown into the space 251V through each outflow opening 51*c*1 is guided by the flow adjusters 255 and 256 along the surface of the moisturizing liquid toward the inflow opening 51*a*1. The air then flows out from the space 251V towards the inflow path 52*af* through each inflow opening 51*a*1 without passing through the moisturizing liquid stored in the space 251V.

As described above, in addition to the effects produced by the arrangements identical with those of First Embodiment, the printer of the present embodiment exerts the effect below because in the space 251V the shape of the air path when the airflow is reversed corresponds to the shape of the air path when the airflow is not reversed. That is to say, the ejection space V1 is uniformly moisturized by the reversal of the airflow, and even when the airflow is reversed, the air flows along the surface of the moisturizing liquid on account of the presence of the flow adjusters 255 and 256, and hence the moisturization is efficiently done.

Figure 13:
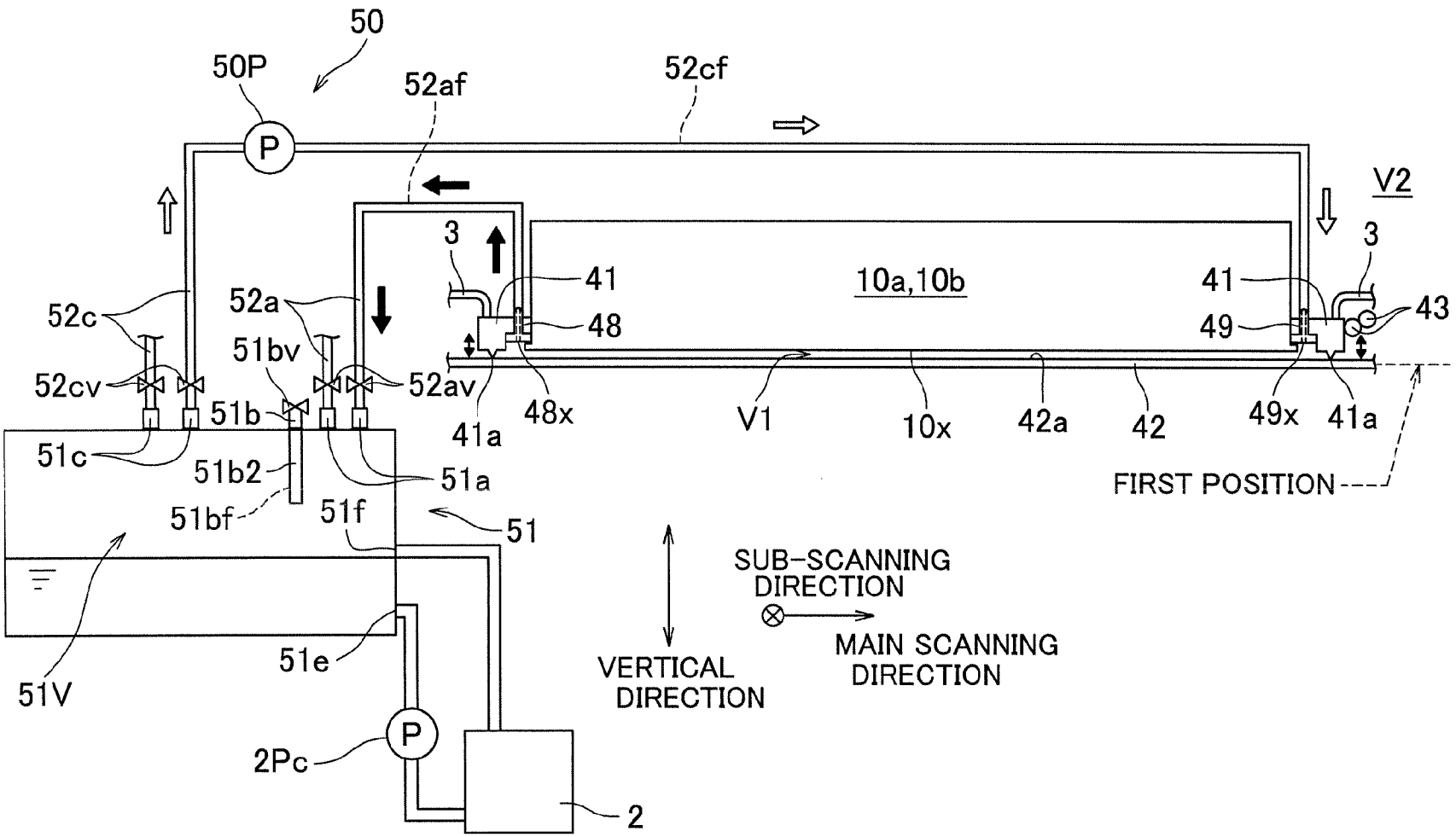
FIG. 13 illustrates a moisturization operation of an inkjet printer according to a modification of First Embodiment of the present invention.

The liquid ejection apparatus is not limited to the printer but, may be a facsimile machine, a photocopier, or the like, The housing of the liquid ejection apparatus is not necessarily composed of two, i.e., upper and lower housings. The housing may be a single housing. The number of heads in the liquid ejection apparatus is any arbitrary number not smaller than one. When more than one head is included in the liquid ejection apparatus, a tank may be provided for each head. The head may eject any type of liquid different from black ink and preprocessing liquid. The head is not necessarily a line-type head but may be a serial-type head. The recording medium is not limited to a sheet P but may be any type of recordable medium. In the embodiment above, the ejection space may be separated from the space surrounding the same for the reason that the annular member 41 contacts not the opposing member 42 but a supporting member (a platen, a conveyance belt, or the like) supporting a recording medium. Furthermore, the capping mechanism is not necessarily composed of a plurality of members (such as the annular member 41 and the opposing member 42 in the embodiment above). For example, the capping mechanism may be: constituted by a single concave member which has, on its upper surface, a concave portion which is substantially identical in size with the ejection surface. The tank may be, provided with a heater for heating the moisturizing liquid. The water level sensor 58 may not be provided as shown in FIG. 13. In such a case, a discharge opening 51*f* for discharging liquid to the cartridge 2 may be disposed slightly vertically above the maximum water level and a supply opening 51 e for supplying liquid from the cartridge 2 may be disposed below the discharge opening 51*f*. When the moisturizing liquid supplied from the moisturizing liquid container of the cartridge 2 to the space 51*y* via the supply opening 51*c* by the driving of the pump 2Pc exceeds the maximum water level, the moisturizing liquid may be discharged through the discharge opening 51*f* and return the moisturizing liquid container of the cartridge 2. The valves for opening and closing the inflow path, the outflow path, the atmosphere connection path or the like may not be provided. The ventilator may be disposed on the inflow path or the outflow path; or on both of these paths. The guide may be formed by an outer wall of the tank. For example, in First and Second Embodiments, the upper space of the chamber 51R2 or 251R2 is excluded from the space 51V or 251V and the excluded space functions as a concave portion of the outer wall of the tank 51 or 251. In this case, the outer wall of the tank 51 in First Embodiment is constituted by the flow adjuster 55, a part of the partition 56 which part is vertically above the notch 56*x*, and a part filling the gap of these members. The outer wall of the tank 251 in Second Embodiment is constituted by the flow adjusters 255 and 256 and a part filling the gap between these members. The guide may not be disposed, in the vertical direction, between the atmosphere opening and the surface of the moisturizing liquid. The path of the air having flown into the tank through the inflow opening, which is defined by the flow adjuster, may not be narrowed by the slope.

For example, as a variation of First Embodiment, the protrusion 51*p* is not provided and the moisturizing liquid is stored in the space Where the protrusion 51*p* is disposed in First Embodiment. In this case, while the path is not narrowed at the slope 55*bx*, the air having flown into the space 51V through the inflow opening 51*a*1 is guided by the flow adjuster 55 toward the outflow opening 51*c*1 along the surface of the moisturizing liquid. The guide may be constituted only by a vertically-extending partition without including a flow adjuster having a slope. The guide may not be provided. In First Embodiment, the partition 57 and the chamber 51R4 may not be provided. The position of the atmosphere opening may not be between the inflow opening and the outflow opening. The atmosphere connection path may not be provided.

Figure 14:
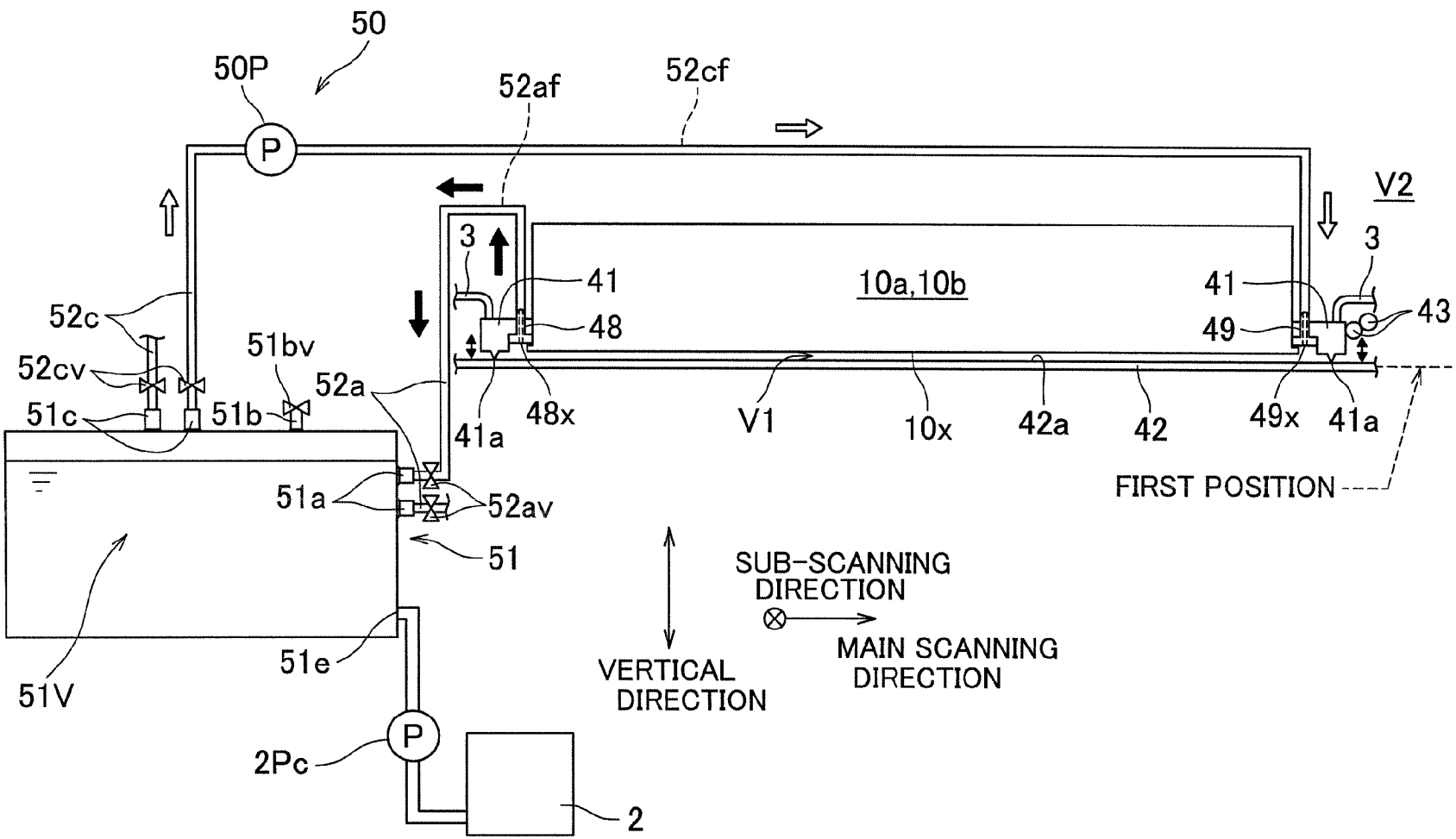
FIG. 14 illustrates a moisturization operation, of an inkjet printer according to Third Embodiment of the present invention.

Now, referring to FIG. 14, an inkjet printer according to Third Embodiment of the present invention will be described. The printer of the present embodiment is substantially identical with the printer 1 of First Embodiment except the structure Of the tank 51. Elements which are the same as those of First Embodiment are designated by the same reference numerals, and redundant descriptions thereof are omitted.

In the present embodiment, being different from First Embodiment, two protruding portions 51*a* are disposed on a side face of the tank 51. An opening (inflow opening) 51*a*1 at the proximal end of the protruding portion 51*a* is disposed at the side face of the tank 51 and on an upper half of the chamber 51R1. Being different from First Embodiment, the water level sensor 58 is not provided.

Below the inflow opening 51*a*1, a supply opening 51*e* is provided for supplying liquid from the cartridge 2. When a user purchases the printer, no moisturizing liquid is stored in the space 51V in the tank 51. As the user attaches the cartridge 2 to the printer, the pump 2Pc is driven for a first predetermined time so that the moisturizing liquid is supplied from the moisturizing liquid container of the cartridge 2 to the space 51V via the supply opening 51*e*. The first predetermined time is determined in advance through experiment so that the water level at this time is above the inflow opening 51*a*1.

Thereafter, as the moisturizing pump 50P of the moisturizing unit 50 is driven and the moisturizing operation is conducted, the moisturizing liquid in the space 51V is reduced substantially in proportion to the increase in the driving time of the moisturizing pump 50P. When the moisturizing liquid in the space 51V almost runs out, the pump 2Pc is driven for the first predetermined time so that the water level of the moisturizing liquid becomes higher than the inflow opening 51*a*1. Because no water level sensor 58 is provided in the present embodiment, whether the moisturizing liquid almost runs out or not is determined based on whether the moisturizing pump 50P has been driven for a second predetermined time which is determined in advance through experiment.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A liquid ejection apparatus comprising:

a head comprising an ejection surface in which a plurality of ejection openings for ejecting liquid are formed;

a tank configured to store moisturizing liquid;

an inflow path which connects a space in the tank with an ejection space opposing the ejection surface, and configured to allow air flow from the ejection space towards the tank passing through the inflow path, an inflow opening of the inflow path opening to the space in the tank;

an outflow path which connects the space in the tank with the ejection space, and configured to allow air flow from the tank towards the ejection space passing through the outflow path, an outflow opening of the outflow path opening to the space in the tank; and a ventilator configured to move the air in the inflow path to the space in the tank and to move the air in the outflow path to the ejection space, wherein:

the inflow opening and the outflow opening are vertically above a maximum level of the moisturizing liquid allowed to be stored in the tank.

2. The liquid ejection apparatus according to claim 1, further comprising a guide configured to guide the air having flown into the tank through the inflow opening toward the outflow opening along the surface of the moisturizing liquid, wherein:

the guide is disposed vertically above the maximum level of the moisturizing liquid between the inflow opening and the outflow opening.

3. The liquid ejection apparatus according to claim 2, wherein:

the guide comprises a flow adjuster at a vertically lower end of which a slope is disposed, the slope being inclined in a direction formed by a direction component running from the inflow opening toward the outflow opening and a direction component running vertically downward.

4. The liquid ejection apparatus according to claim 3, wherein:

a path of the air flowing into the tank through the inflow opening, which path is defined by the flow adjuster, is narrowed by the slope.

5. The liquid ejection apparatus according to claim 2, wherein:

the guide comprises a partition which vertically extends and divides the space in the tank into a plurality of spaces.

6. The liquid ejection apparatus according to claim 5, wherein:

the partition is fixed to both of paired side walls of the tank.

7. The liquid ejection apparatus according to claim 1, further comprising a controller configured to control the ventilator to reverse the flow of the air generated by the ventilator, to cause the air flow from the ejection space towards the tank to pass through the outflow path and to cause the air flow from the tank towards the ejection space to pass through the inflow path, wherein:

a path of the air in the tank when the flow of the air is reversed corresponds in shape to a path of the air in the tank when the flow of the air is not reversed.

8. The liquid ejection apparatus according to claim 1, further comprising an atmosphere connection path which connects the space in the tank with the atmosphere, wherein:

an atmosphere opening of the atmosphere connection path, which opens to the space in the tank, is disposed between the inflow opening and the outflow opening.

9. The liquid ejection apparatus according to claim 8, wherein:

in a vertical direction, a guide is disposed between the atmosphere opening and the maximum level of the moisturizing liquid, the guide configured to guide the air having flown into the tank through the inflow opening toward the outflow opening along the surface of the moisturizing liquid.

10. The liquid ejection apparatus according to claim 1, further comprising:

an atmosphere connection path which connects the space in the tank with the atmosphere;

a plurality of valves configured to open or close the inflow path, the outflow path, and the atmosphere connection path, respectively;

a capping mechanism configured to selectively take a capped state in which the ejection space is covered or an uncapped state in which the ejection space is not covered; and a controller configured to control the valves to close the inflow path, the outflow path, and the atmosphere connection path when the capping mechanism is in the uncapped state.

11. The liquid ejection apparatus according to claim 1, further comprising:

an atmosphere connection path which connects the space in the tank with the atmosphere;

a plurality of valves configured to open or close the inflow path, the outflow path, and the atmosphere connection path, respectively;

a capping mechanism configured to selectively take a capped state in which the ejection space is covered or an uncapped state in which the ejection space is not covered; and a controller configured to control the valves to open the inflow path, the outflow path, and the atmosphere connection path when the capping mechanism is in the capped state and the ventilator is not driven.

12. The liquid ejection apparatus according to claim 1, further comprising:

an atmosphere connection path which connects the space in the tank with the atmosphere;

a plurality of valves configured to open or close the inflow path, the outflow path, and the atmosphere connection path, respectively;

a capping mechanism configured to selectively take a capped state in which the ejection space is covered or an uncapped state in which the ejection space is not covered; and a controller configured to control the valves to open the inflow path, the outflow path, and the atmosphere connection path when the capping mechanism is in the capped state and the ventilator is driven.

13. The liquid ejection apparatus according to claim 1, further comprising:

a level sensor configured to detect a level of moisturizing liquid stored in the tank;

a supplying device which connects the tank and configured to supply the tank with the moisturizing liquid; and a controller configured to control the supplying device to supply the tank with the moisturizing liquid based on the detection result of the level sensor such that the inflow opening and the outflow opening are vertically above a level of the moisturizing liquid stored in the tank.

14. The liquid ejection apparatus according to claim 1, wherein:

the tank is configured to discharge moisturizing liquid through a discharge opening disposed at a side surface of the tank; and the inflow opening and the outflow opening are vertically above the discharge opening.

15. The liquid ejection apparatus according to claim 1, further comprising:

a capping mechanism configured to selectively take a capped state in which the ejection space is covered or an uncapped state in which the ejection space is not covered; and a controller configured to drive the ventilator while maintaining the capping mechanism to be in the capped state when the ejection space is moisturized.

16. The liquid ejection apparatus according to claim 1, wherein:

the air having flown into the tank through the inflow opening flows out to the outflow path through the outflow opening without passing through the moisturizing liquid stored in the tank.

17. A liquid ejection apparatus comprising:

a head comprising an ejection surface in which a plurality of ejection openings for ejecting liquid are formed;

a tank configured to store moisturizing liquid;

an inflow path which connects a space in the tank with an ejection space opposing the ejection surface, and configured to allow air flow from the ejection space towards the tank passing through the inflow path, an inflow opening of the inflow path opening to the space in the tank;

an outflow path which connects the space in the tank with the ejection space, and configured to allow air flow from the tank towards thee ejection space passing through the outflow path, an outflow opening of the outflow path opening to the space in the tank; and a ventilator configured to move the air in the inflow path to the space in the tank and to move the air in the outflow path to the ejection space, wherein:

the inflow opening and the outflow opening are disposed at an upper half portion of the tank.

18. The liquid ejection apparatus according to claim 17, wherein the inflow opening and the outflow opening are disposed at a top surface of the tank.

19. A liquid ejection apparatus comprising:

a head comprising an ejection surface in which a plurality of ejection openings for ejecting liquid are formed;

a tank configured to store moisturizing liquid;

an inflow path which connects a space in the tank with an ejection space opposing the ejection surface, and configured to allow air flow from the ejection space towards the tank passing through the inflow path, an inflow opening of the inflow path opening to the space in the tank;

an outflow path which connects the space in the tank with the ejection space, and configured to allow air flow from the tank towards the ejection Space passing through the outflow path, an outflow opening of the outflow path opening to the space in the tank;

a ventilator configured to move the air in the inflow path to the space in the tank and to move the air in the outflow path to the ejection space;

a level sensor configured to detect a level of moisturizing liquid stored in the tank;

a supplying device which connects the tank and configured to supply the tank with the moisturizing liquid; and a controller configured to control the supplying device to supply the tank with the moisturizing liquid based on the detection result of the level sensor such that the inflow opening and the outflow opening are vertically above a level of the moisturizing liquid stored in the tank.

20. A liquid ejection apparatus comprising:

a head comprising an ejection surface in which a plurality of ejection openings for ejecting liquid are formed;

a tank configured to store moisturizing liquid and to discharge moisturizing liquid through a discharge opening disposed at a side surface of the tank;

an inflow path which connects a space in the tank with an ejection space opposing the ejection surface, and configured to allow air flow from the ejection space towards the tank passing through the inflow path, an inflow opening of the inflow path opening to the space in the tank;

an outflow path which connects the space in the tank with the ejection space, and configured to allow air flow from the tank towards the ejection space passing through the outflow path, an outflow opening of the outflow path opening to the space in the tank; and a ventilator configured to move the air in the inflow path to the space in the tank and to move the air in the outflow path to the ejection space, wherein;

the inflow opening and the outflow opening are vertically above the discharge opening.

* * * * *